US005078921A

United States Patent [19]

Zipperian

[11] Patent Number: 5,078,921

[45] Date of Patent: Jan. 7, 1992

[54] FROTH FLOTATION APPARATUS

[75] Inventor: Donald E. Zipperian, Tucson, Ariz.

[73] Assignee: The Deister Concentrator Company, Inc., Fort Wayne, Ind.

[21] Appl. No.: 551,932

[22] Filed: Jul. 12, 1990

Related U.S. Application Data

[63] Continuation-in-part of Ser. No. 260,813, Oct. 21, 1988, abandoned, and a continuation-in-part of Ser. No. 371,703, Jun. 26, 1989, abandoned, and a continuation-in-part of Ser. No. 444,727, Dec. 1, 1989, Pat. No. 4,971,731.

[51] Int. Cl.[5] ..... B01F 3/04

[52] U.S. Cl. ..... 261/122; 261/DIG. 75; 209/170

[58] Field of Search ..... 261/DIG. 75, 122; 209/170; 210/438

[56] References Cited

U.S. PATENT DOCUMENTS

| | | | |
|---|---|---|---|
| 1,167,835 | 1/1916 | Norris | 209/170 |
| 2,753,045 | 7/1956 | Hollingsworth . | |
| 2,758,714 | 8/1956 | Hollingsworth . | |
| 2,783,884 | 3/1957 | Schaub . | |
| 3,298,519 | 1/1967 | Hollingsworth . | |
| 3,371,779 | 3/1968 | Hollingsworth et al. . | |
| 3,525,437 | 8/1970 | Kaeding et al. . | |
| 3,545,731 | 12/1970 | McManus | 261/122 |
| 4,028,229 | 6/1977 | Dell . | |
| 4,033,863 | 7/1977 | Stone . | |
| 4,215,082 | 7/1980 | Danel . | |
| 4,230,569 | 10/1980 | Lohrberg et al. . | |
| 4,287,054 | 9/1981 | Hollingsworth | 209/170 |
| 4,324,652 | 4/1982 | Hack | 209/170 |
| 4,394,258 | 7/1983 | Zipperian . | |
| 4,431,531 | 2/1984 | Hollingsworth . | |
| 4,565,660 | 1/1986 | Hultholm et al. | 26/121.1 |
| 4,617,113 | 10/1986 | Christophersen et al. . | |
| 4,639,313 | 1/1987 | Zipperian | 261/78.1 |
| 4,680,119 | 7/1987 | Franklin, Jr. | 209/170 |
| 4,735,709 | 4/1988 | Zipperian . | |
| 4,911,826 | 3/1990 | Harach et al. | 209/170 |

FOREIGN PATENT DOCUMENTS

| | | | |
|---|---|---|---|
| 2420482 | 11/1975 | Fed. Rep. of Germany | 209/170 |
| 694918 | 7/1953 | United Kingdom | 261/122 |
| 20234226 | 12/1979 | United Kingdom | 261/122 |
| 2162092 | 1/1986 | United Kingdom | 209/170 |
| 89/07015 | 8/1989 | World Int. Prop. O. | 209/170 |

*Primary Examiner*—Tim Miles

*Attorney, Agent, or Firm*—Barnes and Thornburg

[57] ABSTRACT

A column flotation cell includes a fluid vessel, an exteriorly mounted microbubble generator, conduits for conducting a pressurized mixture of bubbles and liquid from the generator to the vessel, features for inhibiting the coalescence and enlargement of the bubbles prior to their introduction into the vessel, and an arrangement for introducing the bubble/liquid mixture into the vessel and for distributing the mixture uniformly throughout the vessel cross-section. Coalescence and enlargement of the bubbles are inhibited by limiting the length of the mixture-conducting conduits, and by designing the conduits so as to provide a substantially uniform and continuous flow diameter. The uniform and continuous nature of the flow diameter reduces local disturbances of fluid flow which would otherwise occur at discontinuities in the flow path, tending to cause coalescence and enlargement of the bubbles. The inside diameter of the conduit on the downstream end is not greater than the inside diameter on the upstream end so as to maintain the pressure and velocity of the mixture flow substantially constant. A plurality of conduits are preferably used for conducting the mixture from the bubble generator to the vessel. The ends of the conduits within the vessel are flexible and are positioned so as to provide uniform distribution of the bubble/liquid mixture through the vessel cross-section.

23 Claims, 19 Drawing Sheets

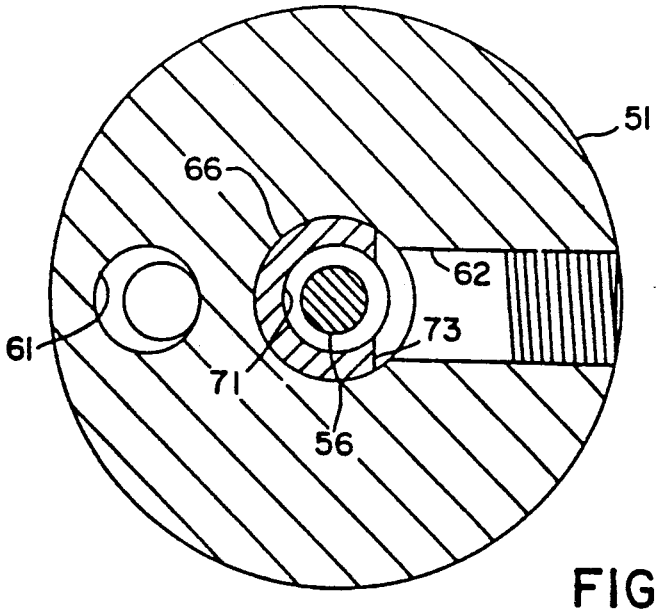
FIG. 4
FIG. 3
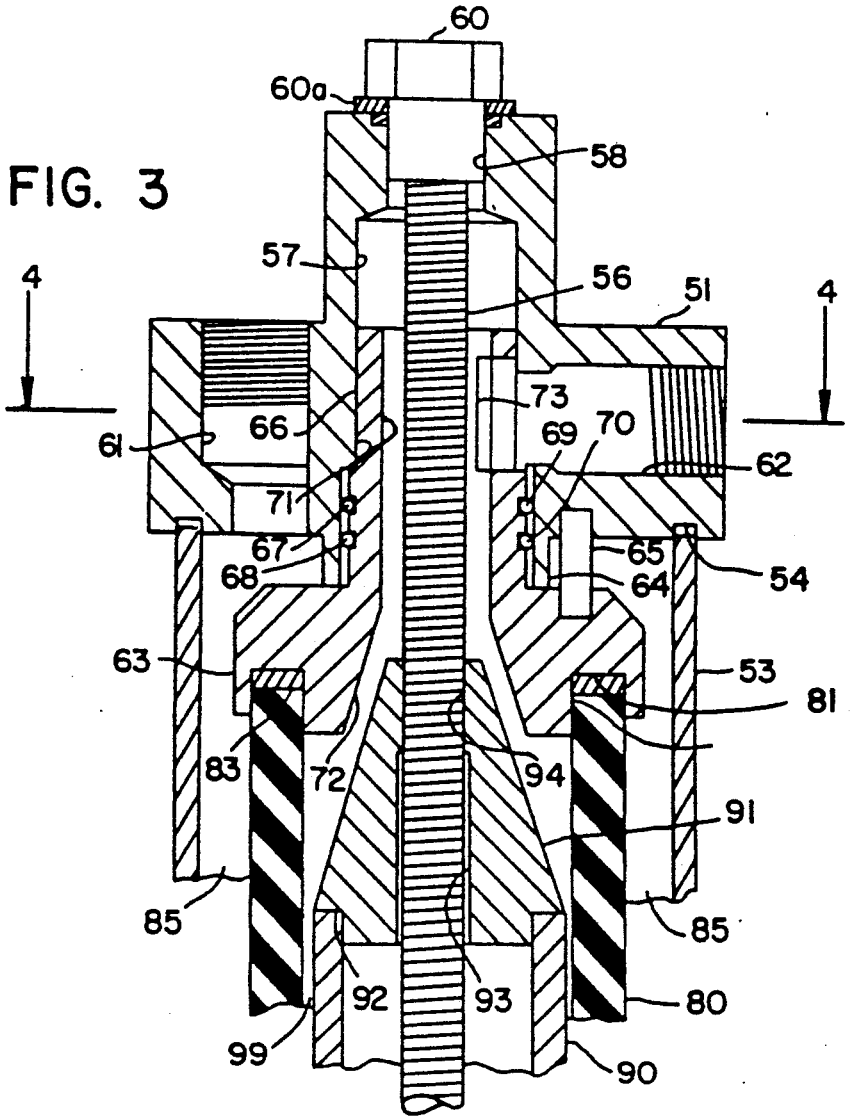

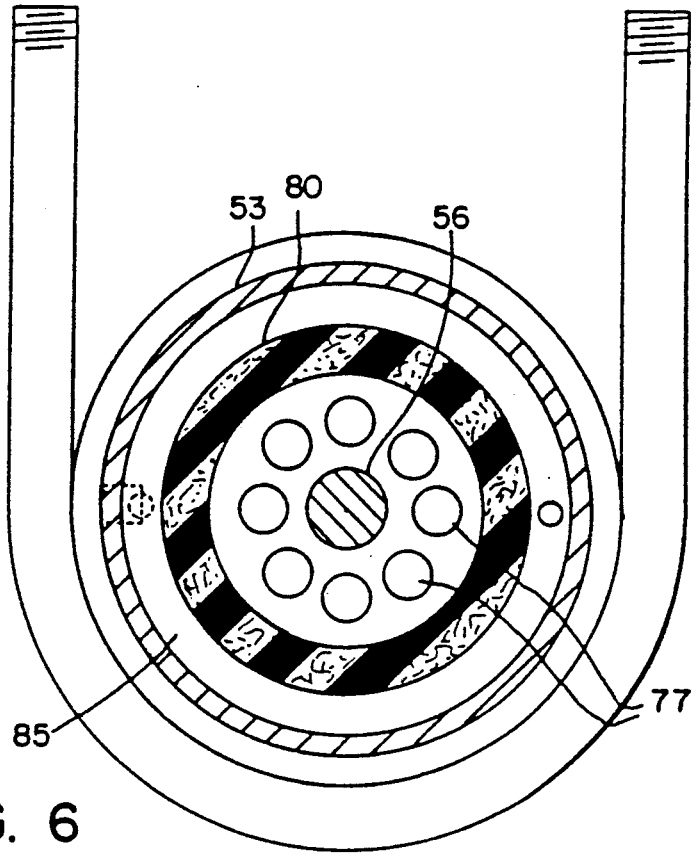
FIG. 6
FIG. 5
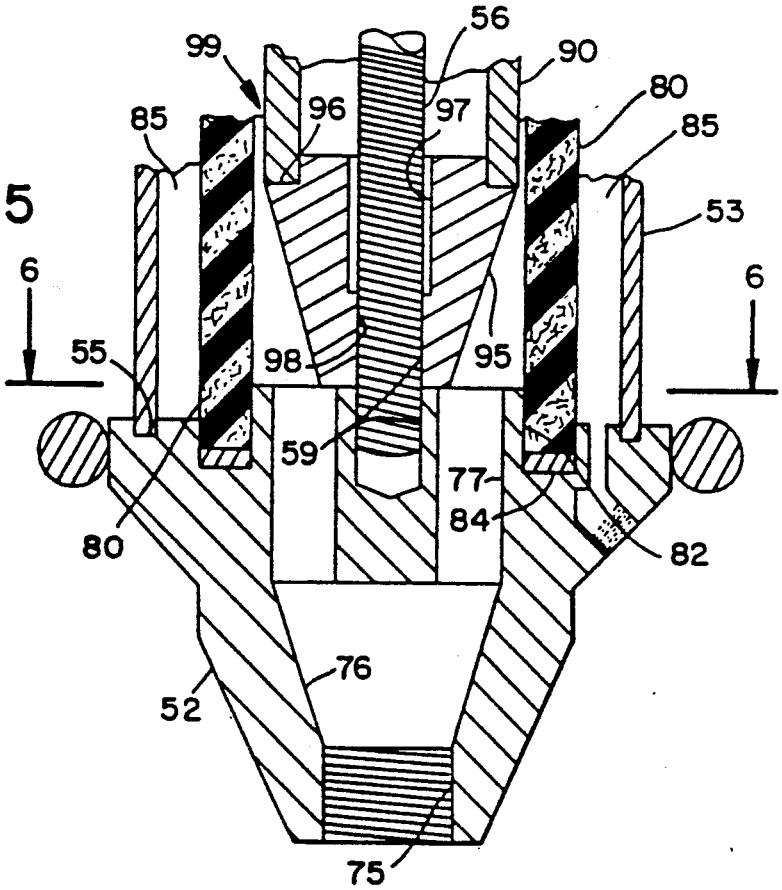

FROTH FLOTATION APPARATUS

BACKGROUND AND SUMMARY OF THE INVENTION

This application is a continuation-in-part of U.S. application Ser. Nos. 260,813 filed Oct. 21, 1988, and 371,703 filed June 26, 1989 (both now abandoned), and U.S. application Ser. No. 444,727 filed Dec. 1, 1989, now U.S. Pat. No. 4,971,731.

This invention relates to the separation of minerals in finely comminuted form from an aqueous pulp by froth flotation process, and especially to a froth flotation system with an improved means for introducing the gaseous medium in the form of minute bubbles into the liquid flotation column. More particularly, the invention relates to a device for generating gas bubbles in a flowing stream of aqueous liquid and delivering the bubble containing stream to the flotation column.

Commercially valuable minerals, for example, metal sulfides, apitictic phosphates, and the like, are commonly found in nature mixed with relatively large quantities of gangue materials. As a consequence, it is usually necessary to beneficiate the ores in order to concentrate the mineral content. Mixtures of finely divided mineral particles and finely divided gangue particles can be separated and a mineral concentrate obtained therefrom by widely used froth flotation techniques.

Froth flotation involves conditioning an aqueous slurry or pulp of the mixture of mineral and gangue particles with one or more flotation reagents which will promote flotation of either the mineral or the gangue constituents of the pulp when the pulp is aerated. The conditioned pulp is aerated by introducing into the pulp minute gas bubbles which tend to become attached either to the mineral particles or the gangue particles of the pulp, thereby causing one category of these particles, a float fraction, to rise to the surface and form a froth which overflows or is withdrawn from the flotation apparatus. The other category of particles, a non-float fraction, tends to gravitate downwardly through the aqueous pulp and may be withdrawn at an underflow outlet from the flotation vessel. Examples of flotation apparatus of this type are disclosed in U.S. Pat. Nos. 2,753,045; 2,758,714; 3,298,519; 3,371,779; 4,287,054; 4,394,258; 4,431,531; 4,617,113; 4,639,313; and 4,735,709.

In a typical operation, the conditioned pulp is introduced into a vessel to form a column of aqueous pulp, and aerated water is introduced into the lower portion of the column. An overflow fraction containing floated particles of the pulp is withdrawn from the top of the body of aqueous pulp and an underflow or non-float fraction containing non-floated particles of the pulp is withdrawn from the column in the lower portion.

In several systems of this type, the aerated water is produced by first introducing a froth or surfactant into the water and passing the mixture through an inductor wherein air is aspirated into the resulting liquid. In order to obtain the required level of aeration, a high flow rate for the water must be maintained through the inductor. While recirculation systems have been devised to minimize the amount of "new" water added to the system, a significant expenditure in energy is required to move such large quantities of water.

Another problem encountered results from the difference between the concentrations of solid particles contained in slurries of different minerals. Phosphates, for example, do not typically require extensive grinding in order to liberate the desired mineral components of the pulp. As a result, the aqueous slurry or pulp fed to the flotation apparatus typically consists of approximately seventy-five percent (75%) solids and twenty-five percent (25%) water. Sulfides, on the other hand, approach the opposite extreme, and typically require extensive beneficiation through grinding of the material to a very fine state in order to liberate the desired minerals from the gangue.

The addition of water throughout the sorting, grinding, and classifying stages of the beneficiation process results in an aqueous slurry comprising approximately ten percent (10%) solid matter and ninety percent (90%) water. Thus, the addition of significant additional amounts of water is undesirable in that significant amounts of the finely ground valuable minerals may avoid capture by the aeration bubbles and remain suspended in the liquid component of the slurry.

Another method for introducing minute air bubbles into the flotation vessel comprises a sparging system such as that disclosed in U.S. Pat. No. 4,735,709. Spargers or microdiffusers are normally tubular members formed of porous material such as sintered stainless steel, porous plastic, ceramic or the like, with a porous wall having a typical average pore size of about 50 microns. The sparger is placed within the flotation vessel and air under pressure is introduced into its interior. The pressurized gas or air within the interior chamber is forced through the pores and into the aqueous pulp in the flotation chamber.

While spargers are used with considerable success, they do have certain disadvantages, including the tendency of the small pores to become clogged with contaminants.

The method and apparatus of the present invention, however, resolve the differences indicated above and afford other features and advantages heretofore not obtainable.

SUMMARY OF THE INVENTION

It is a primary object of the present invention to provide a flotation apparatus for the concentration of minerals which optimizes the separation efficiency.

Another object is to achieve the above result with a minimal amount of water inflow.

Still another object of the invention is to provide a flotation apparatus for the concentration of minerals which has significantly reduced energy consumption requirements, thereby providing more economic operation.

A further object of the invention is to provide a bubble generator adapted for use with a flotation column, which bubble generator is external of the flotation column and thus easily accessible for maintenance.

Another object is to provide a distribution system for bubbles so generated that maintains a minimum and uniform stream velocity so as to inhibit coalescence of the micron-size bubbles.

A further object is to provide such a distribution system with a uniform stream cross-section from the generator to the outlet end.

A still further object of the invention is to produce bubbles for a froth flotation column wherein the bubbles are finer in size than those that can be produced by conventional spargers and with a minimum amount of supply liquid.

Yet another object of the invention is to provide a means for uniformly distributing the bubbles throughout a cross-section of the vessel.

In accordance with the present invention, minute bubbles or microbubbles are first generated in a flowing stream of aqueous liquid and then introduced into the flotation column. The system utilizes a microbubble generator having a tubular housing with an inlet end and an outlet end. Located coaxially within the housing is an inner member with an elongated exterior cylindrical surface.

A porous tubular sleeve is mounted between the housing and the inner member coaxially therewith to define with the cylindrical interior surface of the housing an elongated air chamber of annular cross-section. The porous sleeve also has a cylindrical inner surface that defines, with the exterior surface of the inner member, an elongated liquid flow chamber of thin, annular cross-section.

An aqueous liquid is supplied through a fitting on the housing to the liquid flow chamber and is forced through the flow chamber at a relatively high flow rate and in a thin, annular space to minimize the contact between the liquid and the inner surface of the porous sleeve. Air or other gas under pressure is supplied through another fitting on the housing to the air chamber so that air is forced radially inwardly through the porous sleeve and is diffused in the form of microbubbles in the flowing stream.

Because of the velocity of the flowing stream, the gaseous bubbles passing through the porous sleeve are sheared at the interior surface to produce very fine microbubbles. Accordingly, an aqueous liquid infused with minute gaseous bubbles is discharged from the outlet end of the housing and piped to the flotation vessel. The resulting product is introduced into the flotation column through distribution pipes with openings of a size calculated to maintain a pressure condition that prevents coalescence of the bubbles.

In accordance with a preferred embodiment of the invention, the inner member has a tapered form that tapers from the largest dimension near the inlet end of the flow chamber to a smaller dimension near the outlet end of the flow chamber. Accordingly, the flow chamber has a progressively expanding transverse cross-section. With this arrangement the air that is diffused into the flowing stream as it passes through the porous sleeve is added to the flow without substantially changing the rate of flow through the flow chamber. Accordingly, the increase in cross-sectional area of the flow passage is designed to progressively accommodate the increase in volume due to the infusion of air.

As another aspect of the invention, the lower end of the microbubble generator is provided with a distributor head with a plurality of ports that communicate with the lower end of the flow chamber. The ports are connected to individual conduits that convey the aerated mixture from the microbubble generator to the flotation column. The combined cross-sectional area of the outlet ports is slightly less than the cross-sectional area of the lower end of the flow chamber. Accordingly, there is no fluid velocity decrease in the transition zone at the lower end of the flow chamber to the individual conduits or in the individual conduits. This allows the microbubble generator to provide a plurality of streams without bubble coalescence.

In accordance with still another aspect of the invention, the individual conduits are in the form of flexible tubes that extend through fittings into the interior of the flotation column where they are free to flex in a whip-like fashion so as to increase the bubble distribution area. The discharge cross-sectional areas of the flexible tubes may be slightly less than the overall tube cross-sectional area to maintain a pressure condition that prevents coalescence of the bubbles.

An additional aspect of the invention relates to a column flotation cell which includes a fluid vessel, an exteriorly mounted microbubble generator, means for conducting a pressurized mixture of bubbles and liquid from the generator to the fluid vessel, means for inhibiting the coalescence and enlargement of the bubbles prior to introduction of the mixture into the vessel, and means for introducing the mixture into the vessel and for distributing the mixture uniformly throughout the vessel cross-section. The means for conducting the mixture to the vessel and for inhibiting the coalescence and enlargement of the bubbles comprises at least one conduit extending from a discharge end of the microbubble generator to the vessel. The conduit has a predetermined length and flow diameter which are specifically designed and selected so as to inhibit coalescence and enlargement of the bubbles. In addition to being of a specified, relatively short length, the conduit has a substantially uniform and continuous inside diameter so as to reduce local disturbances of fluid flow which might otherwise tend to cause coalescence and enlargement of the bubbles. Additionally, the inside diameter of the conduit on the downstream end is not greater than the inside diameter on the upstream end so as to maintain the pressure and velocity of the mixture flow substantially constant. In a preferred embodiment, a plurality of conduits are used for conducting the mixture from the bubble generator to the vessel.

The means for introducing the mixture into the vessel and for distributing the mixture uniformly throughout a cross-section of the vessel comprises a plurality of flexible tubes extending into the vessel. Each of the tubes has an open end positioned within the vessel in spaced relation so as to uniformly distribute the mixture throughout the cross-section. The flexible tubes extend through relatively rigid guide tubes of varying lengths, and extend substantially beyond the ends of the rigid guide tubes so as to be free to flex in an oscillating fashion as the mixture is discharged into the vessel. Each of the tube ends flexes within a predetermined portion of the vessel cross-section, and the tube ends are spaced within the vessel to provide substantially complete and uniform distribution of the mixture. The tube ends may be spaced vertically and horizontally to avoid interference between adjacent tube ends.

Each of the flexible tubes enters the fluid vessel through an open valve which is mounted to the vessel by a bushing arrangement. A sealing arrangement is provided with the valves to allow the flexible tube to be withdrawn through the valve for maintenance, repair or replacement purposes without draining the fluid from the vessel.

In an especially preferred embodiment, the flexible tubes are formed in at least two sections. The first section extends from the microbubble generator to a connection point substantially adjacent the exterior wall of the fluid vessel. The second section extends from the connection point into the vessel. Although both sections are somewhat flexible, the first section is substantially less flexible (i.e., more rigid) than the second section. This arrangement allows for an adequate whipping or oscillating motion of the portion of the tube which is located inside the fluid vessel, while providing added strength and stability of the portion of the tube which is located outside the vessel.

Other objects, advantages and novel features of the present invention will become apparent from the following detailed description of the invention when considered in conjunction with the accompanying drawings.

BRIEF DESCRIPTION OF THE DRAWINGS

FIG. 3 is a fragmentary, sectional view on an enlarged scale showing the upper end or inlet end of the microbubble generator of FIG. 2;

FIG. 4 is a sectional view taken along line 4–4 of FIG. 3;

FIG. 5 is a fragmentary, sectional view of an enlarged scale showing the lower end or outlet end of the microbubble generator of FIG. 2;

FIG. 6 is a sectional view taken on the line 6–6 of FIG. 5;

DESCRIPTION OF THE PREFERRED EMBODIMENTS

FIGS. 1–8

Figure 1:
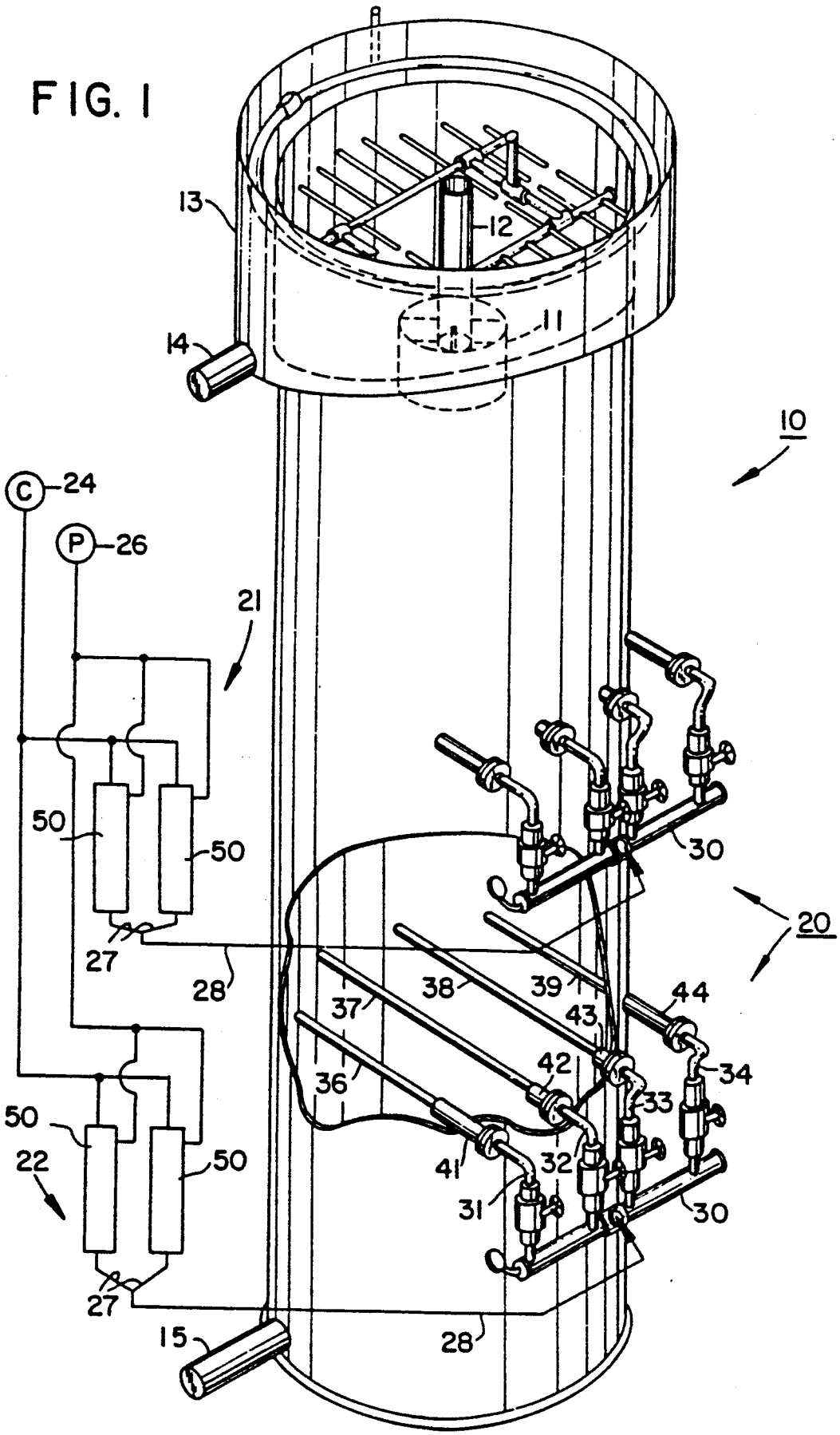
FIG. 1 is a perspective view of a flotation vessel for use in a froth flotation system and having a means for introducing air in the form of minute bubbles into the aqueous slurry, with parts broken away for the purpose of illustration.
Figure 2:
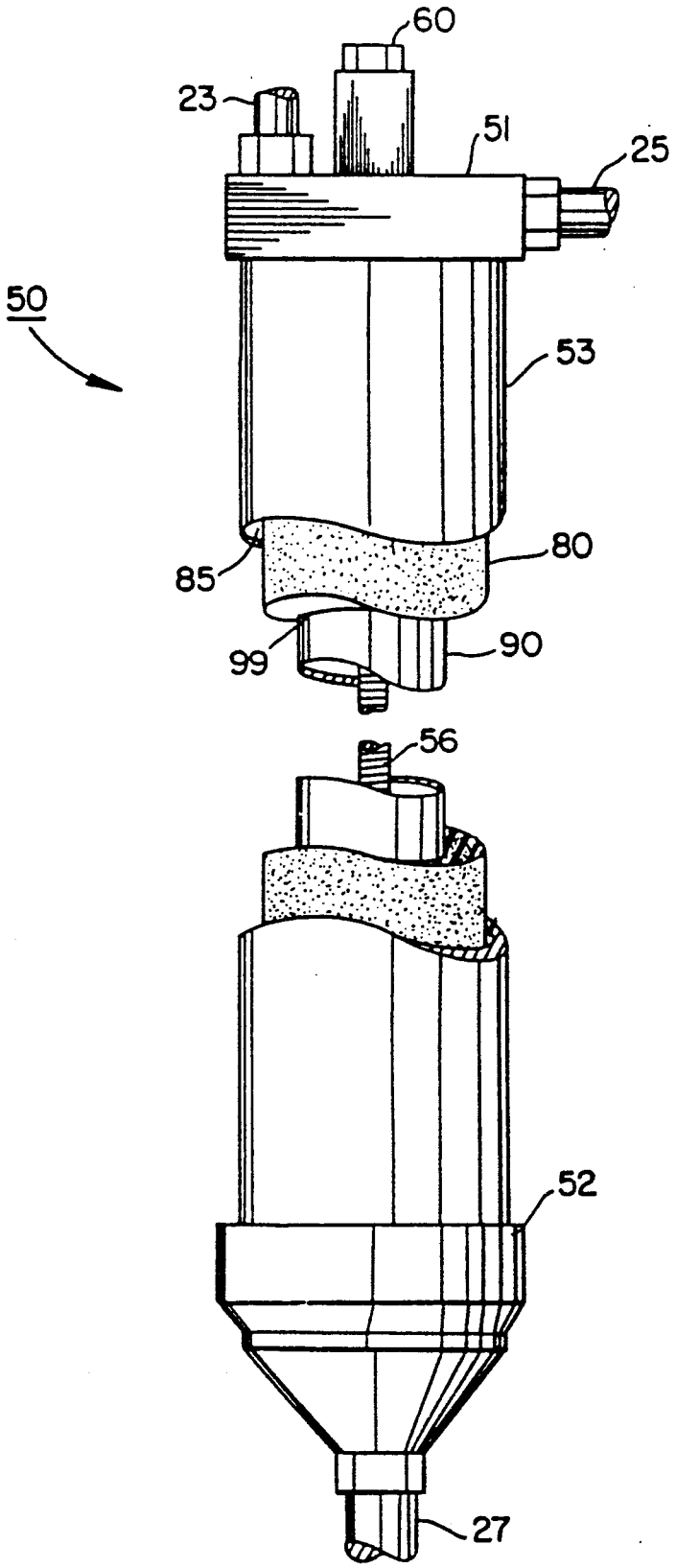
FIG. 2 is a broken, elevational view of a microbubble generator used in the air induction system shown in FIG. 1.
Figure 7:
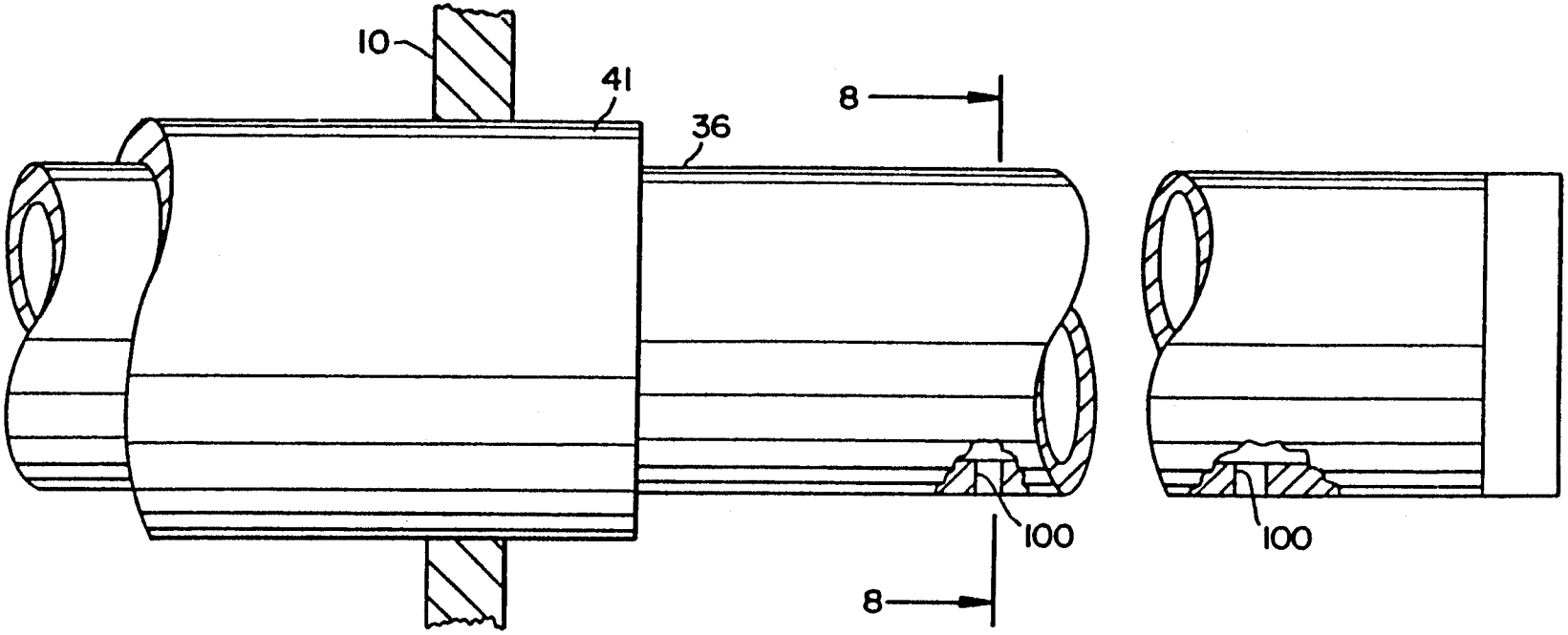
FIG. 7 is a fragmentary, elevational view of a distributor tube.
Figure 8:
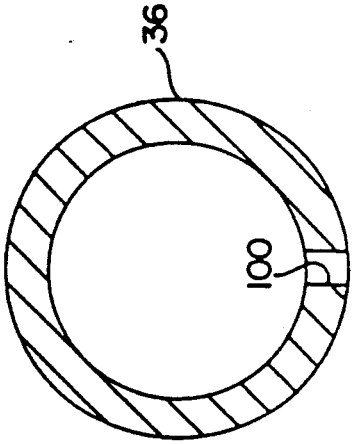
FIG. 8 is a sectional view taken on the line 8–8 of FIG. 7.

Referring more particularly to the drawings, and initially to FIG. 1, there is shown a fluid vessel or cylinder 10 for use in the separation of minerals in finely comminuted form from an aqueous pulp by the froth flotation process. The vessel includes a feed well 11 for feeding the aqueous pulp into the upper end of the flotation column, the pulp being received through a feed tube 12 from an external source of aqueous slurry to deliver a controlled quantity of the slurry to the feed well 11. The feed well 11 may include baffles (not shown) so that the aqueous slurry fed into the feed well becomes distributed throughout the flotation column.

The introduction of aerated water into the fluid vessel 10 is accomplished by means of an air system 20. The aerated water that is introduced tends to flow upwardly through the aqueous slurry and the particulate matter suspended therein so that either the particles of the desired valuable mineral or the particles of the gangue suspended in the aqueous slurry adhere to the rising bubbles and collect at the upper end of the flotation column in the form of a froth. A launder 13 is provided at the upper end of the vessel and is adapted to receive the froth which overflows from the top of the vessel. An output conduit 14 is provided to convey the overflowing froth from the launder 13 to further processing or storage apparatus.

The solid matter not captured by the levitating gas bubbles gravitates downwardly through the aqueous slurry until it collects at the bottom of the column and is removed through an underflow duct 15.

The Air System—General Arrangement

The system for introducing an aqueous mixture containing minute gas bubbles includes an upper system 21 and a lower system 22, each of which has a pair of microbubble generators 50. In the preferred arrangement, only one of the generators 50 of each pair is used at a time, the other generator being used as a spare, such as during repair and replacement. Gas under pressure is supplied to one of the lower system microbubble generators 50 through a branched air inlet 23 that communicates with a compressor 24. An aqueous liquid is supplied to each of the lower microbubble generators 50 through a branched water inlet 25 which is connected to a pump 26 to provide the desired pressure and flow rate.

The resulting aerated liquid is exhausted from the generators through a branched water outlet 27 and then conveyed through pipe 28 to a manifold 30 located on the vessel. The manifold has four outlet pipes 31, 32, 33, and 34 which connect to four distributor tubes 36, 37, 38, and 39, which extend through pipe housings 41, 42, 43, and 44, respectively, into the interior of the vessel. The distributor tubes are provided with a predetermined pattern of small openings through which the aerated water is discharged into the flotation column.

The upper air system 21 is essentially identical to the lower system 22 and, accordingly, like numerals are used to indicate like parts in the system components.

It has been found that the most effective arrangement comprises supplying about one-half or more of the aerated water through the lower system 22 and one-half or more through the upper system 21. Also, it is desirable that the pipe sizes be selected to retain a uniform flow cross-section through the length of the flow so as to maintain a uniform velocity.

The Microbubble Generators

The four microbubble generators 50 are all identical and provide a means for aerating the aqueous liquid flowing into the flotation column, while at the same time minimizing the amount of water or aqueous liquid required to introduce an optimum volume of gas. The generators 50 are each in the form of an elongated tube, typically about 48 inches long (24 inches for some small cells), and most of the components are fabricated of stainless steel to eliminate the effects of corrosion and scale.

Each of the generators includes an upper end member 51 and a lower end member 52 separated by an elongated, cylindrical, tubular housing 53. The upper end of the tubular housing 53 seats in an annular groove 54 formed in the adjacent face of the upper end member 51 and the lower end of the tubular housing 53 seats in an annular groove 55 formed in the adjoining face of the lower end member 52. The resulting assembly is held in place by an elongated, threaded rod 56 which extends through a central bore 57 in the upper end member 51 and axially through the entire length of the tubular housing 53. The axial bore 57 has a narrowed throat portion 58. The lower or inner end of the threaded rod 56 screws into a threaded bore 59 in the lower end member 52. A cap nut 60, with an associated cap centering washer **60*a*, is tightened down on the upper end of the threaded rod 56 and seats in the throat portion 58** to secure the assembly.

The upper end member 51 has an air inlet port 61 that extends in an axial direction and a radial water inlet port 62. Both ports 61 and 62 are adapted to receive fittings that connect to air and water inlet lines, respectively.

The upper end member 51 has an inner fitting 63 associated therewith that seats against an annular axial extension 64 formed on the upper end member so that it does not block the air inlet port 61.

An axially extending locator pin 65 that extends into mating bores in the upper end member 51 and in the inner fitting 63 prevents relatively rotation between the two parts.

An axially extending neck portion 66 of the inner fitting 63 extends upwardly into the axial bore 57. The lower portion of the neck 66 has a pair of spaced, annular grooves 67 and 68 which receive seal rings 69 and 70.

A central axial bore 71 is formed in the inner fitting 63, the bore being provided with a lower tapered portion 72. A tangential slot 73 is milled in the neck portion 66 adjacent the radial water inlet port 62 to provide a passage for water through the neck portion and into the central bore 71. The locater pin 65 assures that the tangential slot is correctly aligned so that the water passage is not blocked.

The lower end of the lower end member 52 has an axial threaded outlet bore 75 formed therein that receives a fitting for the outlet line 27 for the aerated aqueous liquid. The outlet bore 27 communicates with a tapered passage 76, which in turn communicates with a plurality of axially extending, parallel ports 77 formed in a circular pattern in the lower end member 52.

Located within the tubular housing 53 and coaxial therewith is a porous, tubular sleeve 80 that extends axially between the lower end member 52 and the inner fitting 63. The upper end of the sleeve 80 seats in an annular groove 81 formed in the inner fitting 63 and bears against an annular gasket 83 positioned in the groove 81. The lower end of the porous sleeve seats in an annular groove 82 formed in the lower end member 52 and bears against an annular gasket 84 that is seated in the bottom of the groove 82.

Porous sleeve 80 is formed of a porous plastic material manufactured by Porex Technologies, of Fairburn, Ga. The material is a porous polypropylene and has a typical pore size of about 75 microns. The designation used by the manufacturer is POREX XM-1339. Other materials may be used, however, such as sintered stainless steel, porous ceramics, etc. The sleeve 80 is 2.925 inches O.D., and has a wall thickness of about 0.375 inch.

The exterior surface of the porous sleeve 80 and the interior surface of the tubular housing 53 define an elongated, annular air chamber 85 that communicates with the air inlet port 61. The lower end member 52 has a drain port 87 formed therein communicating with the air chamber 85 and an associated drain valve 88 to drain off accumulated oil and particles when necessary.

Located within the porous sleeve 80 is an axially extending filler tube 90 that extends between an upper tip member 91 and a lower tip member 95. The tip members 91 and 95 both have a frustoconical shape, the upper member 91 tapering in an upward direction and the lower tip member 95 tapering in a downward direction to encourage laminar flow.

The upper tip member 91 has an annular rabbet 92 formed in its base that receives the upper end of the filler tube 90 and also has a central axial bore 93 with a threaded upper end portion 94 adapted to be threadedly received on the threaded rod 56.

The lower tip member 95 has an annular rabbet 96 formed in its base portion and adapted to receive the lower end of the filler tube 90. The lower tip member also has a central axial bore 97 with a threaded portion 98 at its lower end adapted to be threaded onto the threaded rod 56. The exterior surface of the filler tube 90, together with the tapered exterior surface of the two tip members 91 and 95, define with the interior surface of the porous sleeve 80, a thin, annular fluid passage 90 for the aqueous fluid that is supplied through the inlet port 62. It is desirable that the fluid passage 99 be relatively thin in its cross-section perpendicular to the direction of flow and in the embodiment shown, the passage is about 0.094 inch in radial thickness. This dimension varies, of course, with the size of the generator.

The aqueous liquid entering through the port 62 passes through the slot 73 into the central bore 71 within the inner fitting 63. The flow proceeds downwardly through the lower tapered portion 72 adjacent the central bore 71 and then outward into the annular flow passage 99, as shown in FIG. 3. As the water flows along the annular passage 99, gas passing through the porous sleeve 80 becomes entrained in the flow so that the resulting aqueous fluid that exits through the outlet 75 has a volume of gas entrained therein in the form of minute bubbles.

Because the relatively high velocity or flow rate of water or aqueous liquid is maintained through the passage 99, gas bubbles that emerge at the interior surface of the porous sleeve are effectively sheared by the flow to obtain extremely small bubble sizes.

Because the radial thickness of the water flow passage 99 is relatively small, e.g., 0.094 inch, the surface area of the flowing mass of water that contacts the interior surface of the porous sleeve 80 is relatively large with respect to the cross-sectional area of the flow passage. This assures that a maximum amount of gas is entrained in the flowing liquid in the form of minute bubbles.

As indicated above, it is important that a constant pressure be maintained in the air systems between the microbubble generators 50 and the distributor tubes 36, 37, 38, and 39 in order to prevent bubble expansion or growth prior to their delivery to the flotation column. If pressure and flow velocity are not properly maintained, the minute bubbles may coalesce and be less effective in separating the desired float fraction from the aqueous pulp.

In order to maintain this pressure, the small ports or holes 100 formed in the distributor tubes must be of a proper size to assure that a substantial pressure drop does not occur within the distributor tubes. A Preferable arrangement is to provide openings located on the bottom of the tube and spaced between about 2.5 to 7.5 inches apart. The openings preferably have a diameter of between about one-sixteenth inch and one-eighth inch. These spacings and hole sizes may vary, of course, depending upon the size of the vessel and the length of the particular distributor tube.

For larger vessels, the tubes may extend into the flotation column from opposite sizes of the vessel from separate manifolds. Preferably, tube lengths are kept substantially equal. Some typical hole sizes and spacings are shown in Table I below, together with dimensions for respective microbubble generators 50.

TABLE I

| Cell Dia. (ft.) | Microbubble Generator 50: Housing 53 (Inches) O.D./I.D. | Porous Tube 80 (Inches) O.D./I.D. | Inner Tube 90 (Inches) O.D. | Passage 99 Area (Sq. Inch) | Distributor Tubes (.5 inch O.D.): Hole Dia. (Inch) | Number of Holes/Tube Upper/Lower | Area Per Hole (Sq. Inch) Upper/Lower | Total Area of Holes (Sq. Inch) |
|---|---|---|---|---|---|---|---|---|
| 2 | 4/3.75 | 2.925/2.215 | 2.0 | .712 | 1/16 | 12/16 | .037/.049 | .086 |
| 2.5 | 4/3.75 | 2.925/2.215 | 2.0 | .712 | 5/64 | 12/16 | .057/.076 | .133 |
| 3 | 4/3.75 | 2.925/2.215 | 2.0 | .712 | 3/32 | 12/16 | .083/.110 | .193 |
| 5.5 | 4/3.75 | 2.925/2.215 | 1.66 | 1.69 | 7/64 | 28/40 | .263/.370 | .376 |
| 6.5 | 4/3.75 | 2.925/2.215 | 1.66 | 1.69 | ¼ | 30/42 | .368/.520 | * |
| 8.0 | 4/3.75 | 2.925/2.215 | 1.315 | 2.50 | ¼ | 46/62 | .565/.760 | * |

*Individual generators supply mixture to each level for these cells.

Operation

The operation of the system shown will be described with respect to a vessel 10 filled with a particular aqueous pulp containing a mixture of a valuable mineral and gangue and wherein it is desired to separate by froth flotation the valuable mineral in the froth at the top of the column. The froth containing the float fraction is removed through the launder 13.

During the process, the aqueous pulp will be fed at a controlled rate through the feed pipe 12 into the feed well 11. Aerated water will be fed at a controlled rate through both the upper and lower distribution systems 21 and 22, the flow rate being about twice as great in the lower system as in the upper or intermediate system.

The process begins with the infusion of an aqueous liquid with microbubbles by means of the microbubble generators 50. Gas is supplied to the generators by the compressor 24 and water is supplied by means of the water pump 26 or head pressure, which pumps the water at a desired predetermined pressure. Recommended flow rates for various sizes of flotation cells are shown in tabular form in Table II below, it being understood that these are variable. For example, satisfactory operation has been achieved using less water and air at lower pressure, ranging as low as 40 psi.

TABLE II

| CELL DIA. | GENERATOR PSI (AIR) | AIR SUPPLY SCFM | GENERATOR PSI (WATER) | WATER SUPPLY GPM |
|---|---|---|---|---|
| 8" | 70 | 2 | 70 | .05 |
| 2.0' | 70 | 15 | 70 | 4 |
| 2.5' | 70 | 20 | 70 | 5 |
| 3.0' | 70 | 30 | 70 | 8 |
| 5.5' | 70 | 100 | 70 | 25 |
| 6.5' | 70 | 140 | 70 | 35 |
| 8.0' | 70 | 200 | 70 | 50 |
| 10.0' | 70 | 320 | 70 | 80 |
| 12.0' | 70 | 450 | 70 | 115 |

The gas enters each of the microbubble generators 50 through the inlet port 61 and fills the annular space 85 surrounding the exterior surface of the porous sleeve 80. The aqueous liquid, which is preferably water mixed with a typical surfactant of the type well known in the art, is supplied through the radial port 62 and flows through the central passage 71 into the annular water flow passage 99, where it flows along the interior surface of the porous sleeve 80.

The gas pressure in the gas chamber 85 forces air through the small pores (i.e., about 75 microns in pore size), so that it emerges at the cylindrical interior surface of the sleeve, where it contacts the flowing aqueous liquid. Due to the relatively high velocity of the liquid flow, the bubbles are sheared from the surface as they emerge and become entrained in the form of minute bubbles in the flowing stream.

By the time the flowing stream has reached the lower end of the microbubble generator, an optimum volume of gas has been entrained in the stream in the form of minute bubbles and the resulting mixture exits through the outlet 75. The stream is then conveyed through the line 27 to the respective manifold 30. There it divides into four flow paths through the pipes 31, 32, 33, and 34, and ultimately into the distributor tubes 36, 37, 38, and 39.

The resulting liquid is then introduced into the flotation column through the small holes 100 in the respective tubes. The minute gas bubbles then levitate through the aqueous slurry in the flotation column and the particles of the desired valuable mineral adhere to the bubbles and collect at the upper end of the flotation vessel in the form of froth. The froth overflows into the launder 13, where it is collected and delivered to the output conduit 14, which conveys it away for further processing.

Using the well-understood principal that bubble-rise time diminishes with size diminution, the apparatus herein disclosed provides for greater efficiency in material recovery. Since bubble size is small, retention time within the water column is correspondingly large. The finer bubbles provide maximum surface area for attachment to descending particles. Turbulence within the water column is minimized whereby bubbles tend to follow only substantially vertical paths. Larger bubbles tend to be erratic and to create voids therebelow which result in descending particles moving somewhat laterally rather than downwardly.

The distributor pipes 36, 37, 38, 39 extend horizontally across the cross-section of the cell (as shown in FIG. 1), have evenly spaced openings 100, and are evenly spaced apart so as to provide a substantially uniform cross-section of bubbles thereabove in the column 10.

Two levels or elevations of distributor pipes are used, thereby creating two recovery zones within the column 10, one between the two pipe sets and the other above the upper set. The lower set is two to four feed above the tailings discharge port (not shown) in the bottom of the column 10, while the upper set is disposed midway between the lower set and the upper end of the column 10.

In the upper recovery zone, bubbles from both pipe sets will obtain. In the lower zone, the only bubbles will be those from the lower set. Thus, bubble density is correspondingly different in the two zones. Bubbles in the upper zone, being more concentrated, attach to and immediately float off that particle fraction most susceptible to float separation. The remaining particles descend through the lower zone where the fine bubbles are ascending relatively slowly, the slow ascent creating more time during which attachment to descending particles may occur. Primary recovery, therefore, may be said to occur in the upper zone, and scavenging in the lower zone.

Of importance is the fact that bubble generation and sizing are external to column 10 and that the same size bubbles are fed to both of the upper and lower sets of pipes. Since rising bubbles progressively expand in size, those bubbles introduced at the lower level will enlarge by the time they reach the upper level. Thus, some of the desired qualities of tiny bubbles will there be lost. However, tiny bubbles are introduced at the upper level and will rise vertically, providing maximum surface area for particle attachment. Thus, by means of multilevel bubble introduction of externally generated bubbles, bubble size is maintained optimally small, thereby enhancing the probability of particle attachment.

Tiny bubble introduction at the different levels also minimizes turbulence within the column water. Smaller bubbles tend to create less disturbance and to follow vertical paths. Thus, there will be minimal turbulence in the lower zone, as bubble size is small. In the upper zone whereby bubble concentration is greater, the distance to the water surface is relatively short and the introduction of small bubbles tends to infiltrate smaller bubbles with the enlarged ones and ascendancy remains substantially vertical. Turbulence in the form of circular motion or boiling action is thereby minimized, contributing further to the efficiency of material pick-up. The two sets of distributor pipes at the two levels, receiving and emitting the same size bubbles, inhibit development of turbulence, thereby enhancing column efficiency.

FIGS. 9—13

Figure 9:
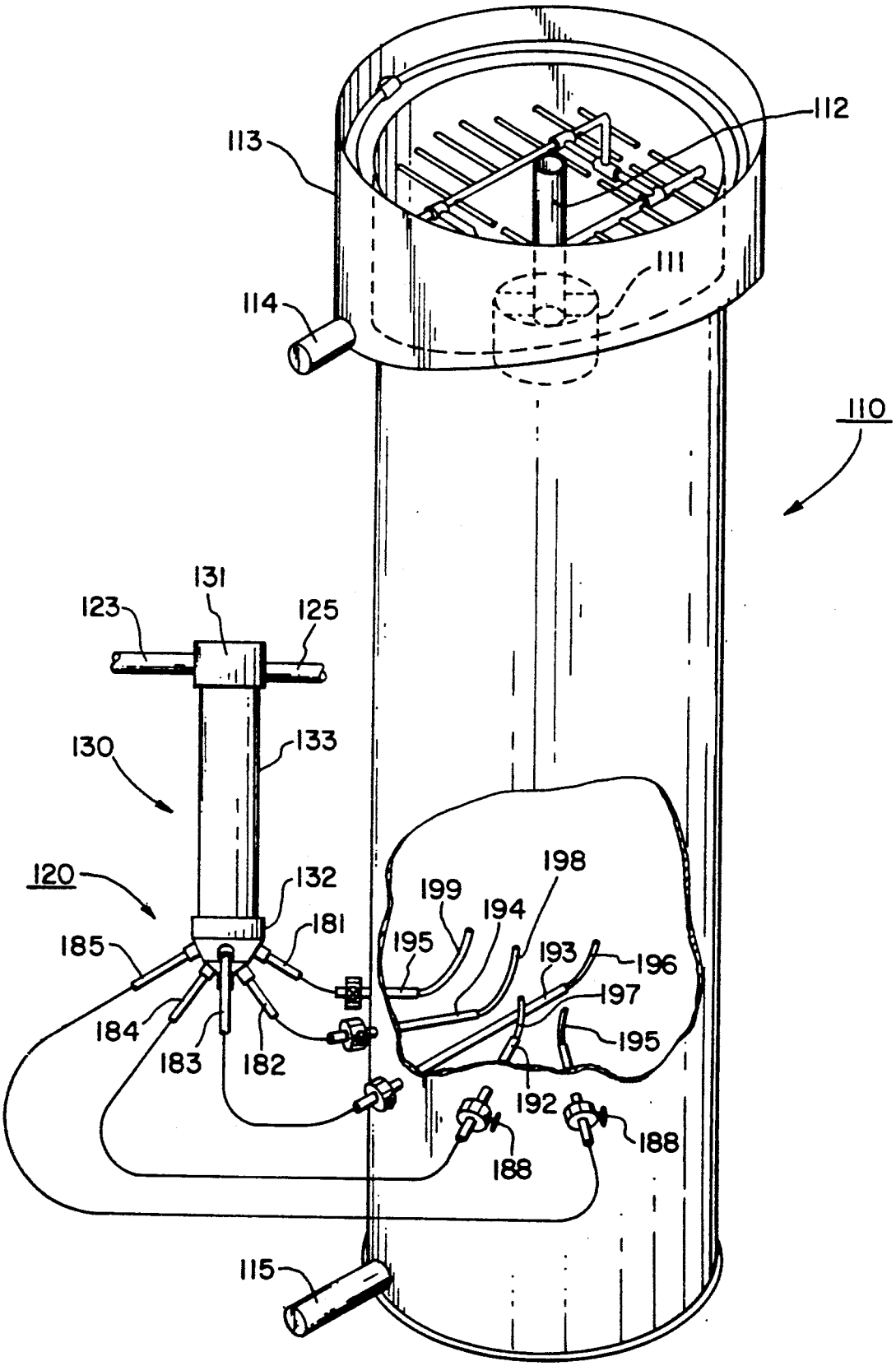
FIG. 9 is a perspective view of a preferred form of flotation vessel for use in a froth flotation system and having means for introducing air in the form of minute bubbles into the aqueous slurry, with parts broken away for the purpose of illustration.
Figure 10:
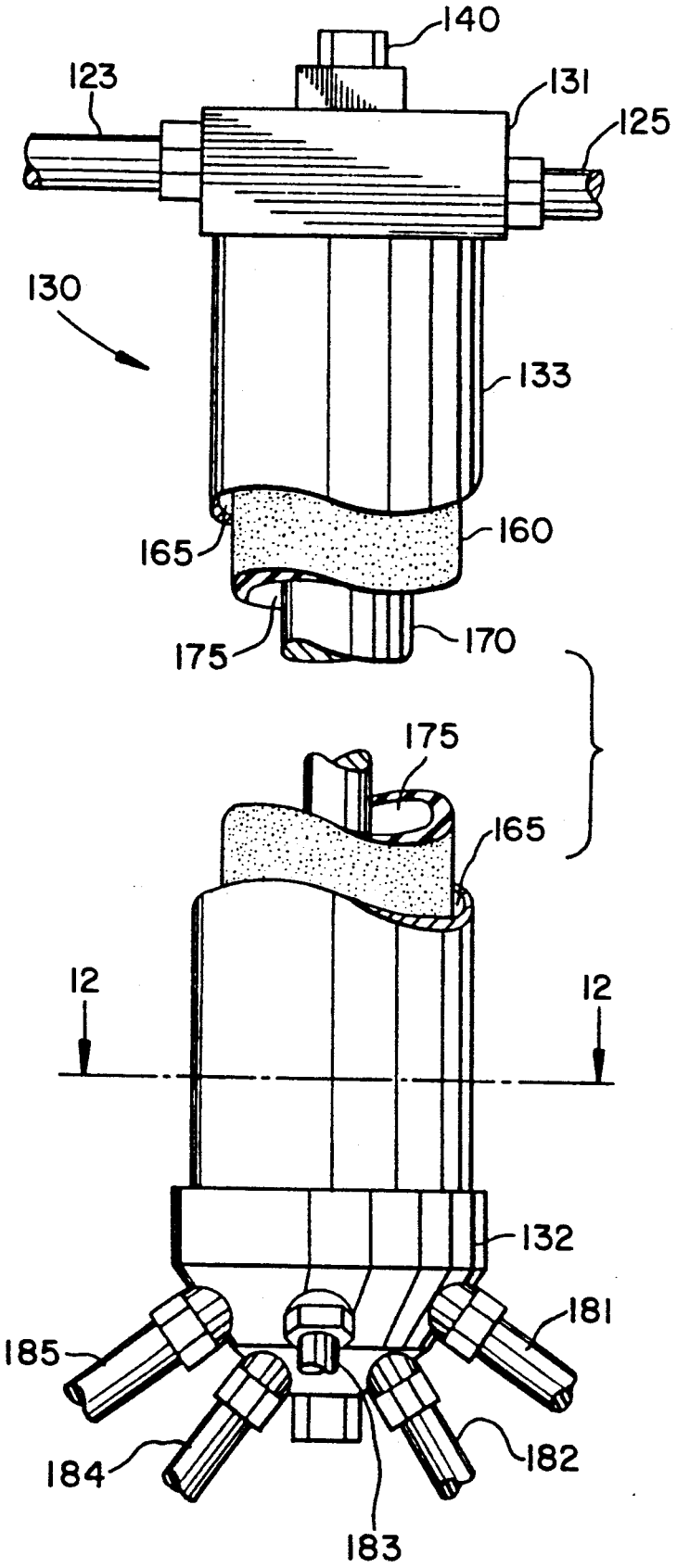
FIG. 10 is a broken elevational view of another embodiment of a microbubble generator as might be used in the air induction system shown in FIG. 9.
Figure 11:
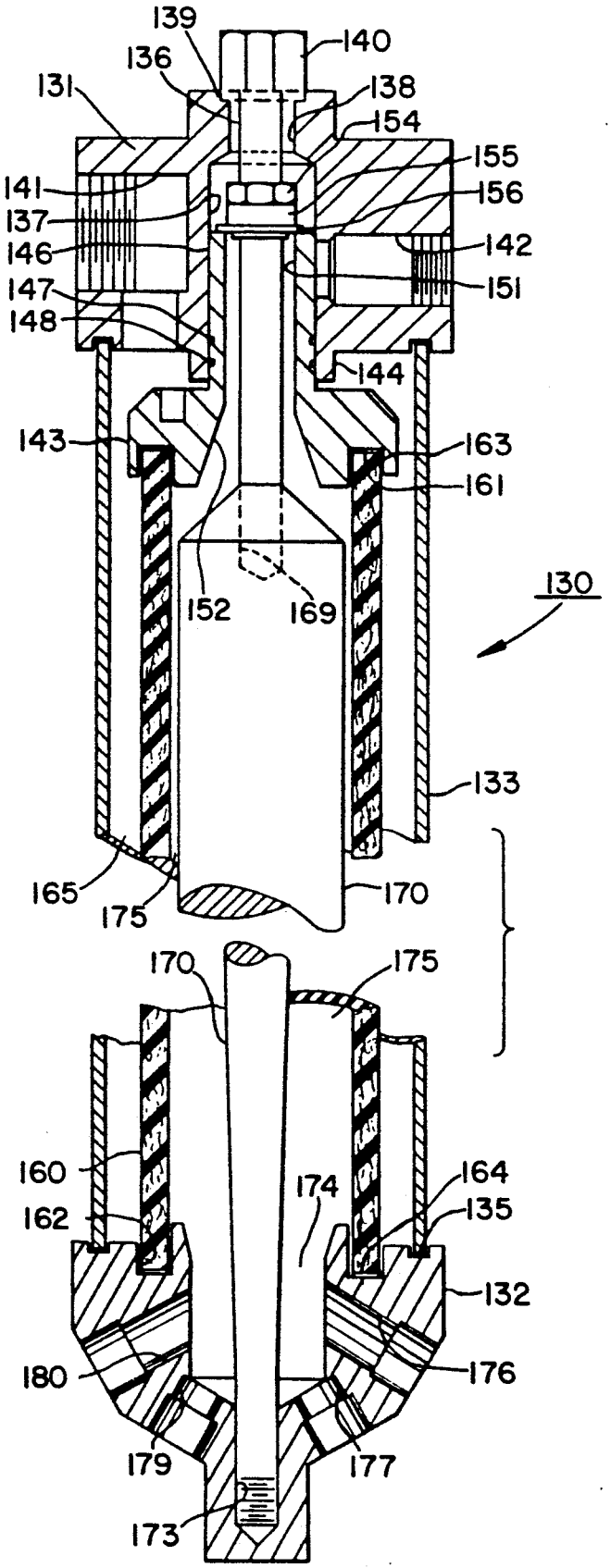
FIG. 11 is a fragmentary sectional view on an enlarged scale with the middle portion broken away showing the microbubble generator of FIG. 10.
Figure 12:
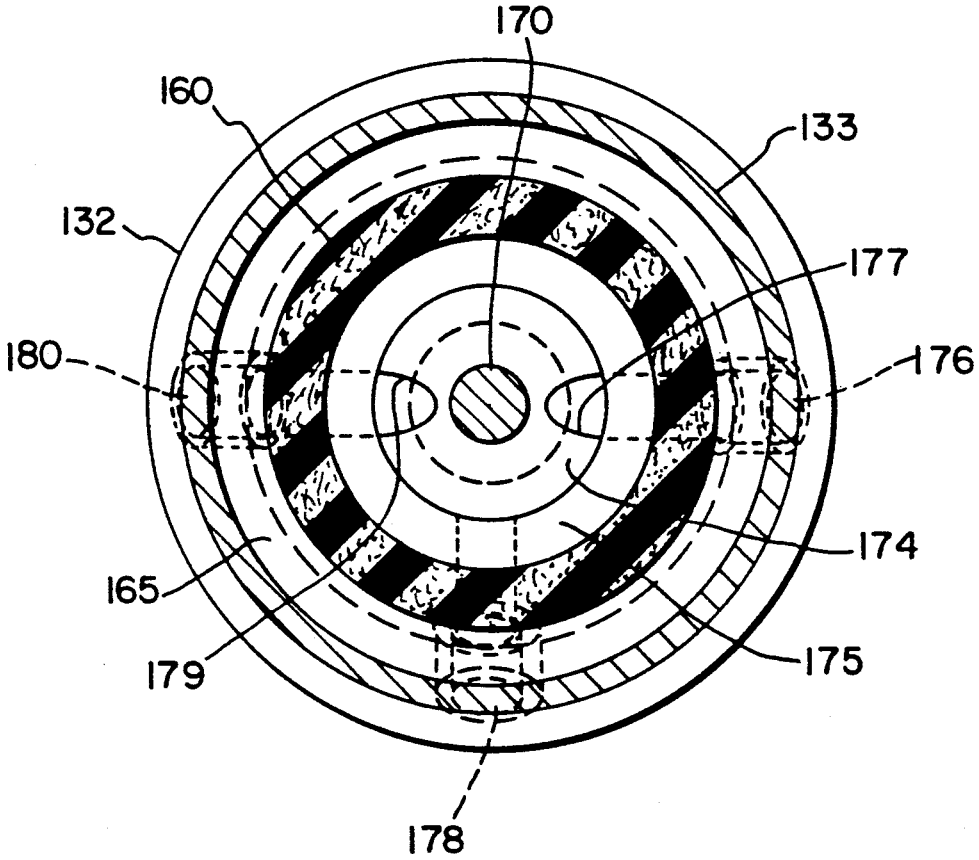
FIG. 12 is a sectional view on an enlarged scale, taken on the line 12—12 of FIG. 10.
Figure 13:
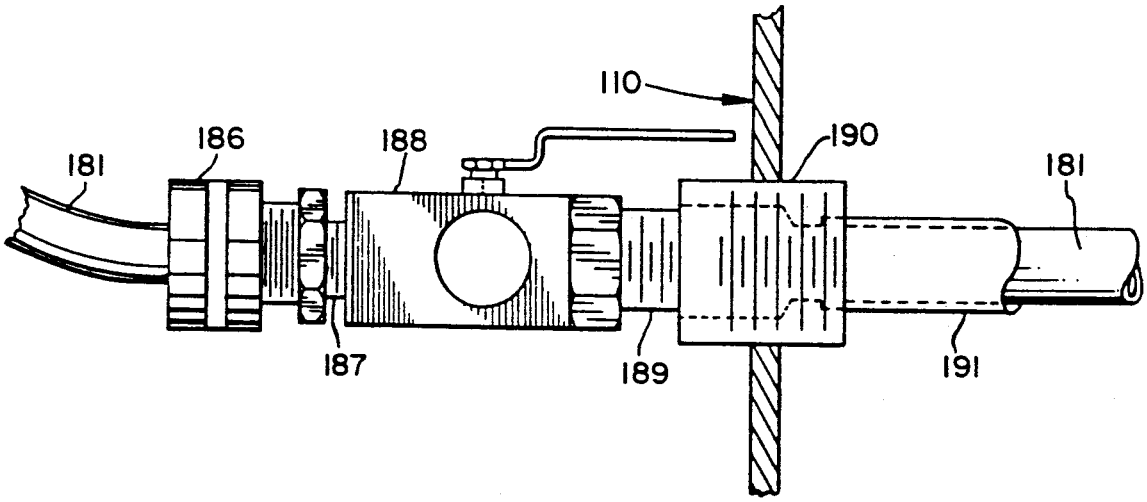
FIG. 13 is a fragmentary elevational view showing the connection to an insertion of one of the distributor tubes coming from the microbubble generator into the flotation vessel of FIG. 9.

Referring to FIGS. 9 to 13, and initially to FIG. 9, there is shown a fluid vessel or column 10 embodying certain aspects of the present invention. As with the fluid vessel 10 shown in FIG. 1, there is shown a feed well 111 and a feed tube 112. The introduction of aerated water into vessel 110 is accomplished by means of an alternate form of air system 120. A launder 113 is provided at the upper end of the vessel to receive the froth which overflows from the top and an output conduit 114 is provided to convey the overflowing froth for further processing. The solid matter that collects at the bottom of the column is removed to an underflow duct 115.

The Microbubble Generator Air system 120 includes a microbubble generator 130 which receives gas under pressure through an air inlet 123 and water under pressure through a water inlet 125.

The microbubble generator 130 is in the form of an elongated tube, typically about 48 inches long, and most of the components are fabricated of stainless steel. The generator includes an upper end member 131 and a lower end member 132 separated by an elongated, cylindrical, tubular housing 133. The upper end of the tubular housing 133 seats in an angular groove 134 formed in the adjacent face of the upper end member 131 and the lower end of the tubular housing 133 seats in an annular groove 135 formed in the adjoining face of the lower end member 132.

A threaded rod 136 extends through a central bore 137 in the upper end member 131 and which has a narrowed throat portion 138. A cap nut 140, with an associated cap centering washer 139, is tightened down on the upper end of the rod 136 and seats in the throat portion 138.

The upper end member 131 has a radial air inlet port 141, and a radial water inlet port 142. Both ports 141 and 142 are adapted to receive fittings that connect to air and water inlet lines, respectively.

The upper end member 131 has an inner fitting 143 associated therewith that seats against an annular axial extension 144 formed on the upper end member so that it does not block the air inlet port 141.

An axially extending locator pin 145 that extends into mating bores in the upper member 131 and in the inner fitting 143 prevents relative rotation between the two parts.

An axially extending neck portion 146 of the inner fitting 143 extends upwardly into the axial bore 137. The lower portion of the neck 146 has a pair of spaced annular grooves 147 and 148 which receive seal rings 149 and 150.

A central axial bore 151 is formed in the inner fitting 143, the bore being provided with a lower tapered portion 152. A tangential slot 153 is milled in the neck portion 146 adjacent the radial water inlet port 142 to provide a passage for water through the neck portion and into the central bore 151. The locator pin 145 assures that the tangential slot is directly aligned so that the water passage is not blocked.

A pair of jamb nuts 144 and 145 are threaded on the rod 136 midway between its ends at a location just above the neck portion 146. The nuts serve to lock themselves in a fixed position on the threaded rod and the bear against a locater washer 156 that, in turn, bears against the upper end of the neck portion and which has a lower portion tightly received within the axial bore formed within the neck portion 146.

Located within the tubular housing 133 and coaxial therewith is a porous, tubular sleeve 160 that extends axially between the lower end member 132 and the inner fitting 143. The upper end of the sleeve 160 seats in an annular groove 161 formed in the inner fitting 143 and bears against an annular gasket 163 positioned in the groove 161. The lower end of the porous sleeve 160 seats in an annular groove 162 formed in the lower end member 132 and bears against an annular gasket 164 that is seated in the bottom of the groove 162.

The exterior surface of the porous sleeve 160 and the interior surface of the tubular housing 133 define an elongated, annular air chamber 165 that communicates with the air inlet port 141. The lower end member 132 has a drain port 167 formed therein communicating with the air chamber 165 and an associated drain valve 168 to drain off accumulated oil and particles when necessary.

The lower end of the threaded rod 136 is received in a threaded axial bore 169 formed in the upper end of a tapered flow control form or rod 170. Rod 170 tapers inwardly from a maximum diameter at the upper end thereof adjacent the upper end member 131 to a smaller diameter located adjacent lower end member 132. The lower end of tapered rod 170 is threaded and received in a threaded axial bore 173 formed in lower end member 132.

Located above the threaded bore 172, and within the lower end member 132, is a transition chamber 173.

The exterior surface of the tapered flow control form 170 and the interior surface of the porous sleeve 160 define a fluid passage 175 that progressively increases in its annular cross-section in the direction of flow from the upper end of the microbubble generator 130 to the lower end thereof. The progressively increasing cross-section is designed to accommodate the progressive increase in the volume of the liquid/gas mixture as air is diffused into the flowing liquid through the porous sleeve 160. The infusion of the microbubbles results in more than doubling the volume as the flow progresses through the microbubble generator, but the velocity remaining roughly the same from one end of the generator to the other.

A plurality of discharge ports—in this case five—are formed in the lower end member 132 and all communicate with the transition chamber 174. The cross-sectional area of five discharge ports is designed slightly less than the maximum cross-sectional area of the annular flow passage 175 to avoid any fluid velocity decrease in the transition zone from the flow passage to the individual exit ports. Five flexible hoses 181, 182, 183, 184, and 185 are connected to the respective discharge ports 176 through 180, respectively, to receive the aqueous fluid and convey it to the flotation column.

The hoses all extend through fitting assemblies in the wall of the flotation column into the interior of the column, where the aqueous liquid is discharged from the end of the flexible hose directly into the column. The fitting assemblies at each instance include a compression fitting 186 tightly received around the hose, a connected fitting 187 between the compression fitting, a globe valve 188, and a short nipple connected between the globe valve and the bushing 190 welded in place in the wall of the fluid vessel. The globe valve is turned to an open position and the hose extends completely through the bore in the globe valve.

Inside the flotation column, hoses 181 extend through stainless steel guide tubes 191 through 195 of varying lengths adapted to position the ends of the hoses at a position to achieve uniform air distribution. The guide tubes may be curved as desired to achieve the desired distribution. The hose ends 196 through 200 extend substantially beyond the ends of the rigid guide tubes 191 through 195, and are free to flex in a whipping fashion as the air-infused mixture is discharged therefrom into the flotation column.

This arrangement provides minimum resistance to the flow of the gas-infused liquid from the microbubble generator to the flotation column, and prevents coalescence of bubbles which would otherwise reduce the effectiveness of the flotation column.

OPERATION

The gas, which may be air, for example, enters microbubble generator 130 through the inlet port 141 and fills the air chamber 165 surrounding the exterior surface of the porous sleeve 160. The aqueous liquid, which is preferably water or brine mixed with a typical surfactant of the type well known in the art, is supplied through the radial port 142 and flows through the central passage 151 into the flow passage 175, where it remains in continuous contact with the interior surface of the porous sleeve 160.

The gas pressure in the gas chamber 165 forces air through the small pores (i.e., about 75 microns in pore size) so that it emerges at the cylindrical interior surface of the sleeve, where it contacts the flowing aqueous liquid. Due to the relatively high velocity of the liquid flow, the bubbles are sheared from the surface as they emerge and become entrained in the form of minute bubbles in the flowing stream. As the flowing stream progresses from the inlet end to the outlet end of the microbubble generator, its volume is substantially increased, due to the infusion of gas. Accordingly, the flow chamber 175 increases progressively in size at a rate adapted to accommodate the increase in volume without resulting in an excessive increase in velocity or pressure.

By the time the flowing stream has reached the lower end of the microbubble generator, an optimum volume of gas has been entrained in the stream in the form of minute bubbles and the resulting mixture exits through the five discharge ports 176 through 180. The individual stream then conveyed through the respective hoses 181 through 185 into the interior of the flotation column and the resulting liquid is then delivered from the open ends of the hoses into the interior of the column. The minute gas bubbles then levitate through the aqueous slurry in the flotation column and the particles of the desired valuable mineral adhere to the bubbles and collect at the upper end of the flotation vessel in the form of froth. The froth overflows into the launder 113, where it is collected and delivered to the output conduit 14, which conveys it away for further processing.

FIGS. 14–20

Figure 14:
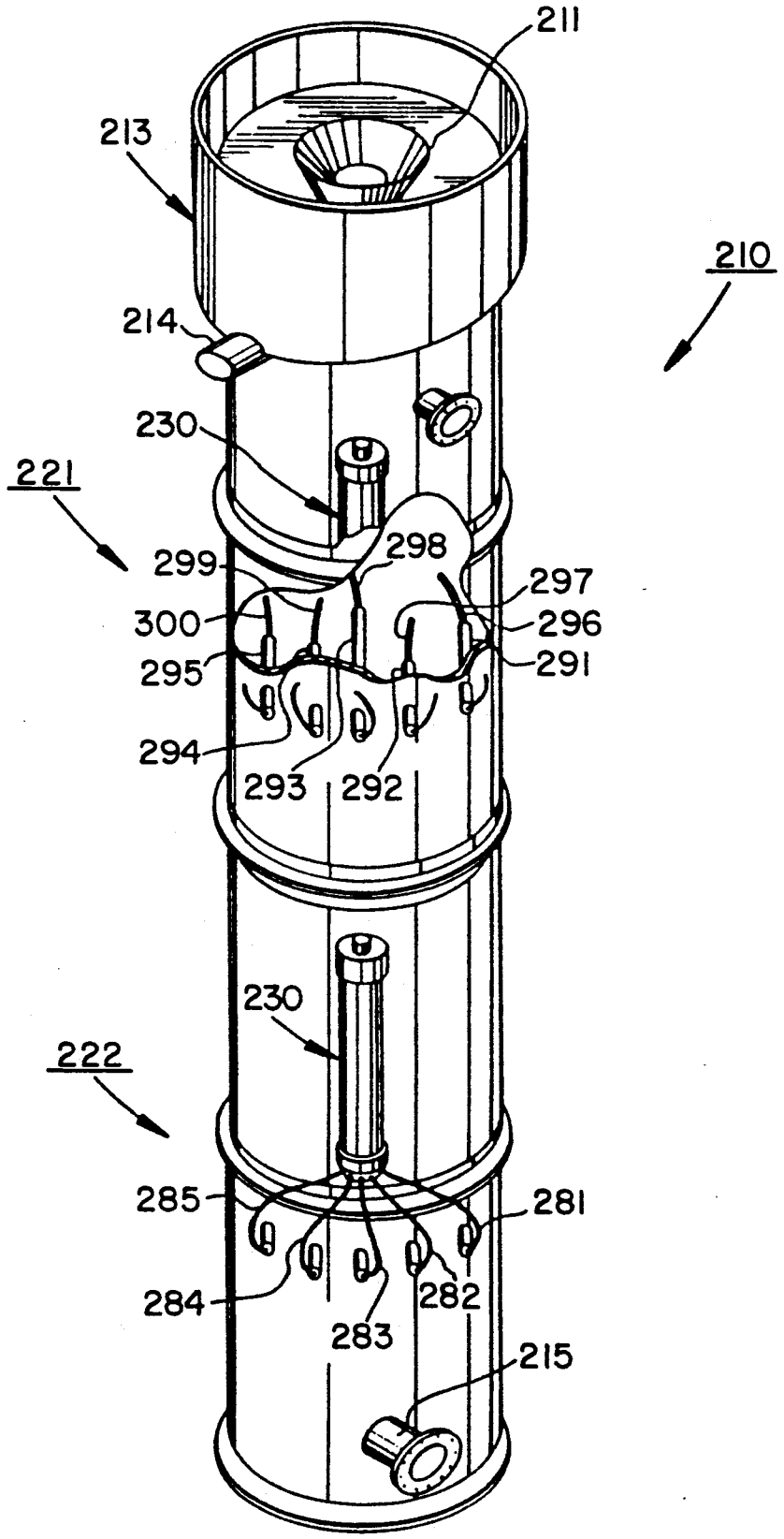
FIG. 14 is a perspective view of another embodiment of a flotation vessel for use in a froth flotation system and having means for introducing air in the form of minute bubbles into the aqueous slurry, with Parts broken away for the purpose of illustration.
Figure 15:
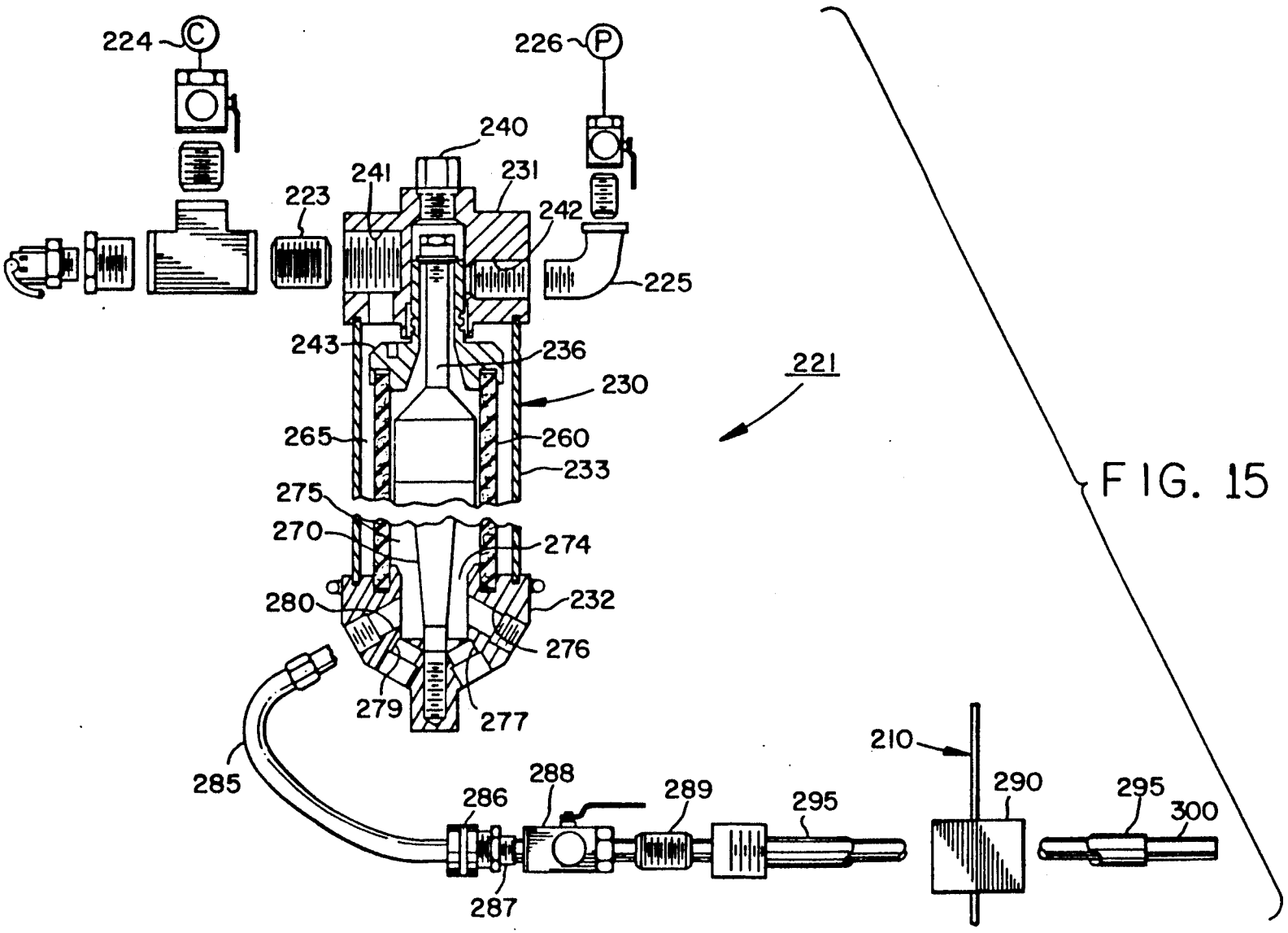
FIG. 15 is a partially exploded sectional view in somewhat diagrammatic form of one of the two air systems shown in FIG. 4.
Figure 16:
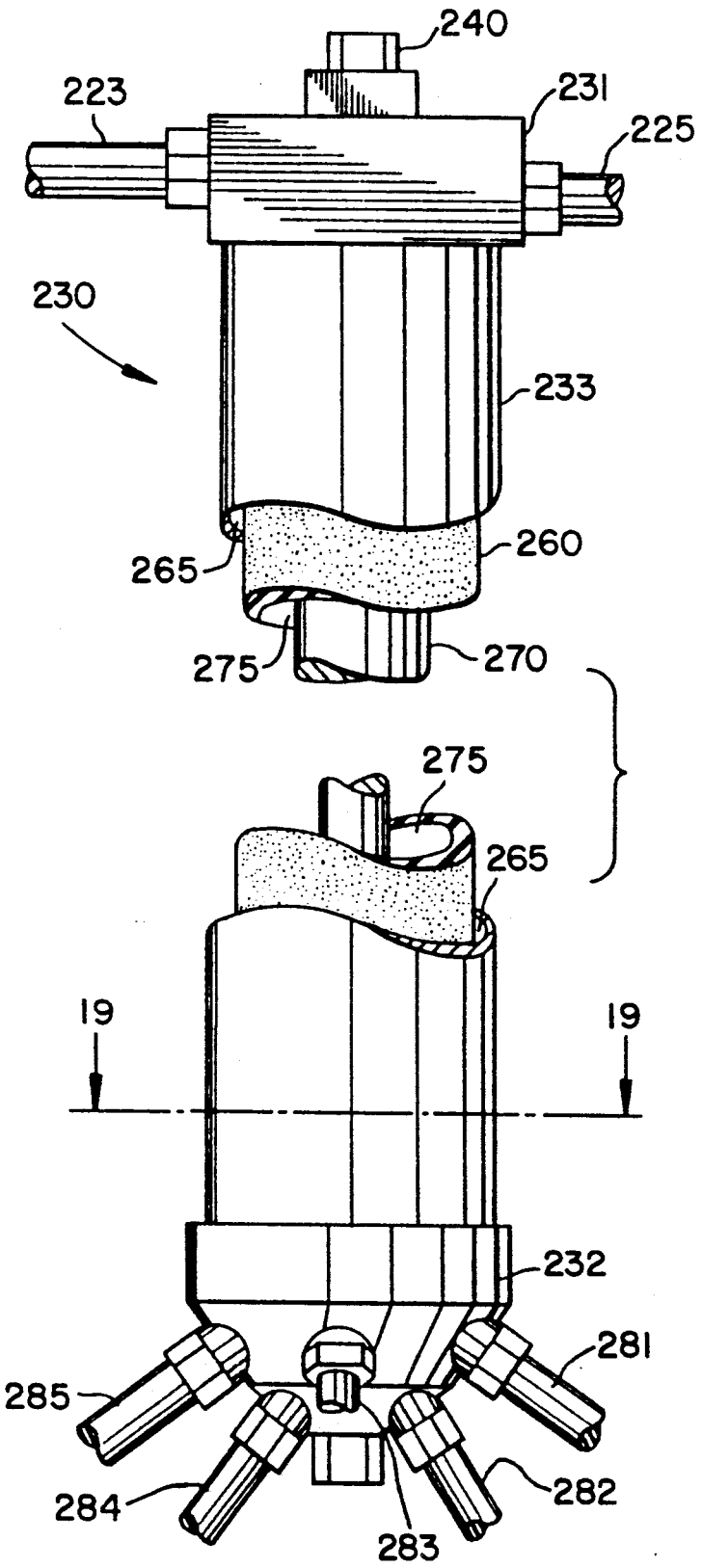
FIG. 16 is a fragmentary, broken elevational view on an enlarged scale of the microbubble generator of FIG. 15.
Figure 17:
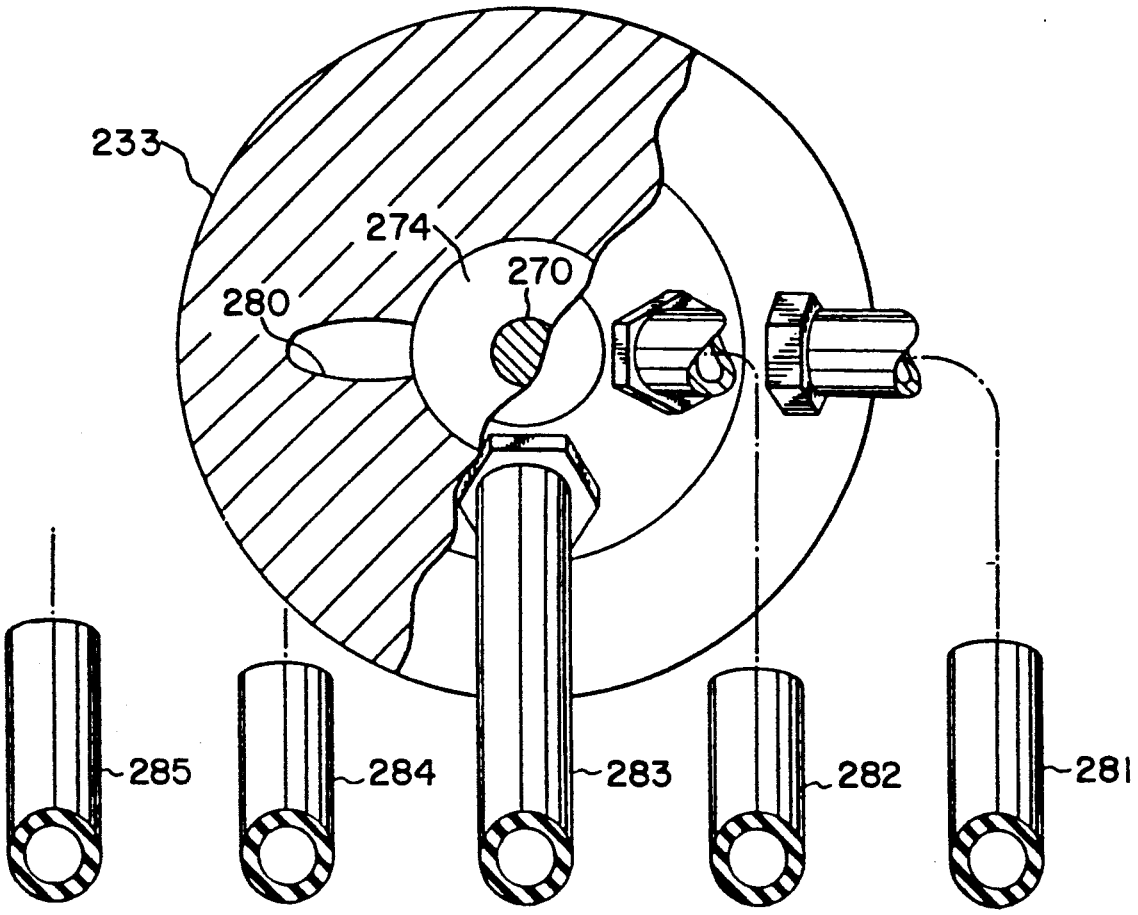
FIG. 17 is a lower end elevational view of the microbubble generator of FIG. 16 on an enlarged scale, with parts broken away and shown in section for the purpose of illustration.
Figure 18:
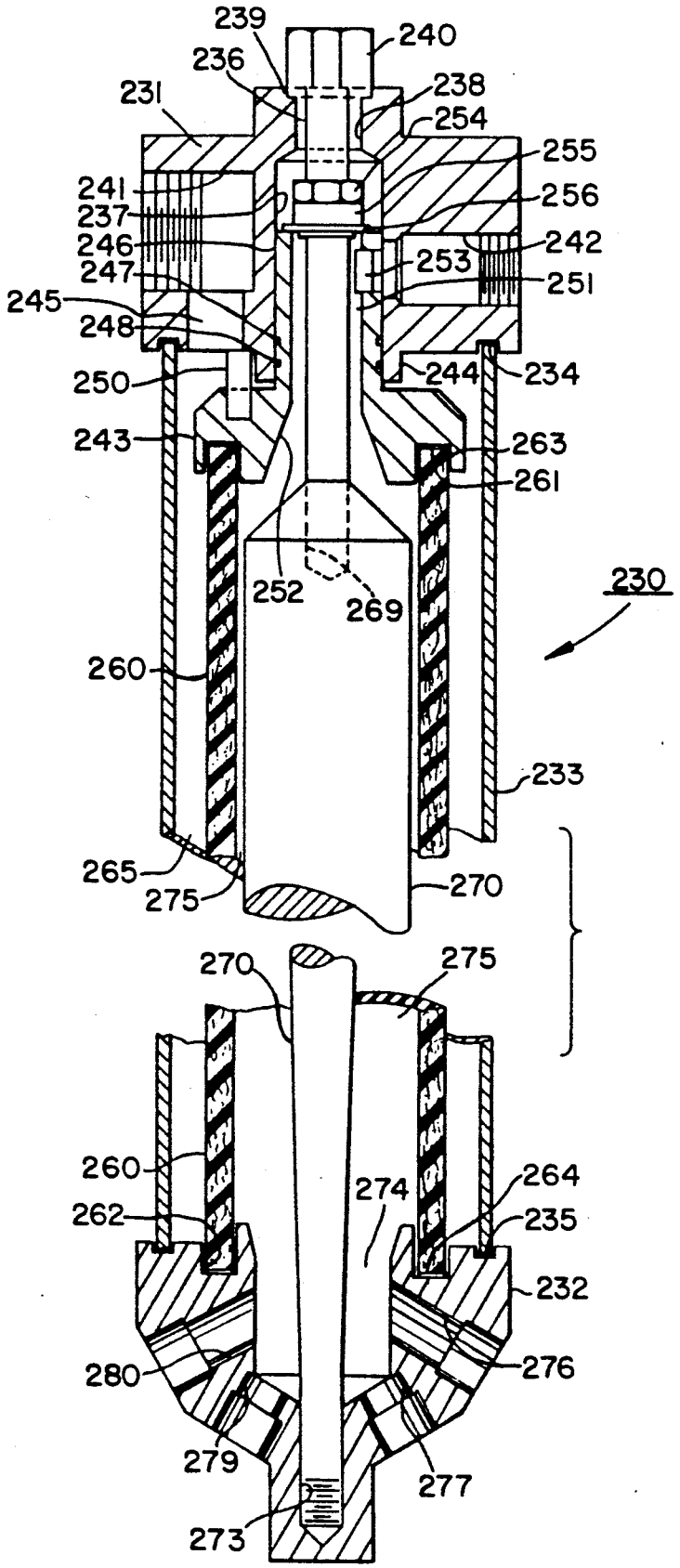
FIG. 18 is a fragmentary sectional view on an enlarged scale with the middle portion broken away showing the microbubble generator of FIG. 16.
Figure 19:
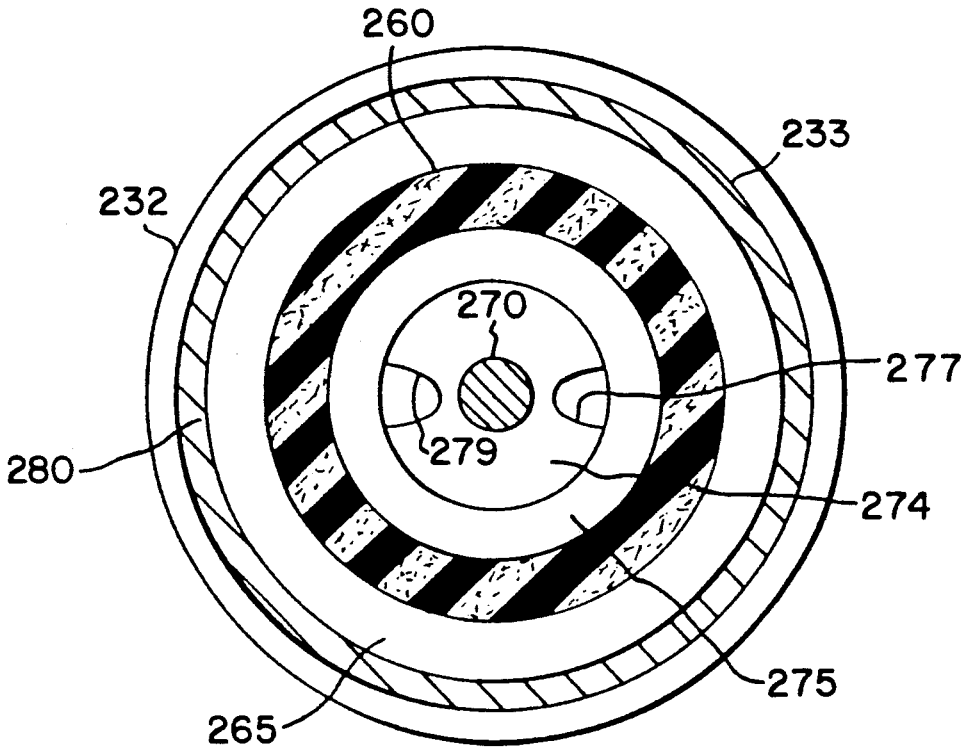
FIG. 19 is a sectional view on an enlarged scale, taken on the line 19—19 of FIG. 16.
Figure 20:
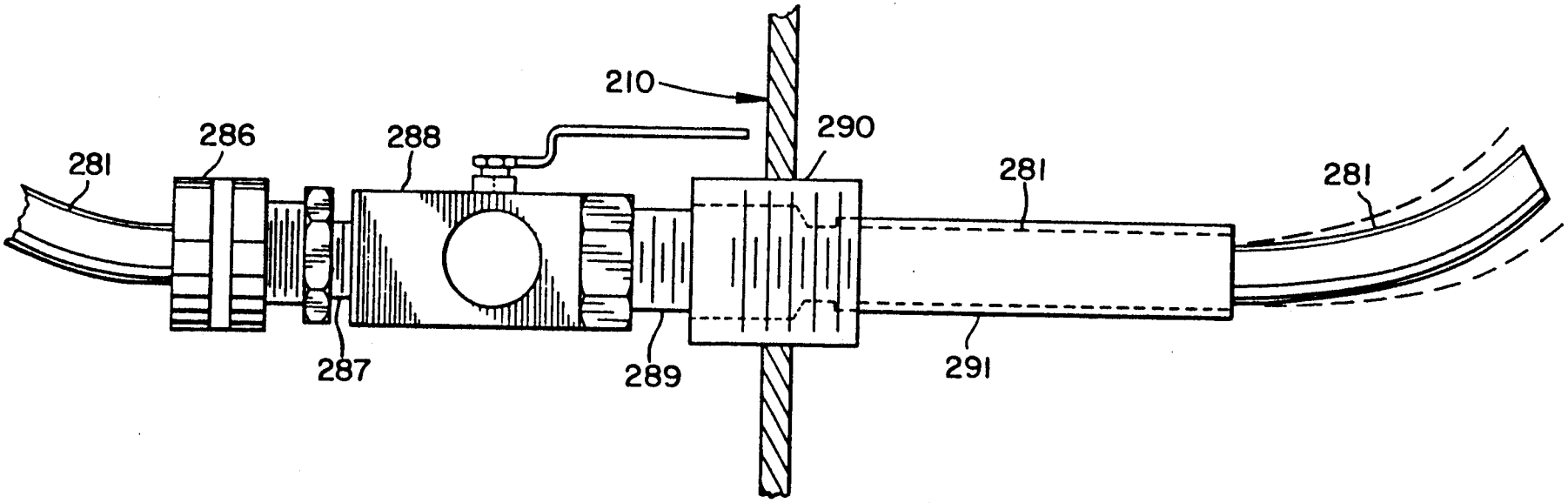
FIG. 20 is a fragmentary elevational view showing the connection to an insertion of one of the distributor tubes coming from the microbubble generator into the flotation column.

Referring to FIG. 14, there is shown a fluid vessel or cylinder 210 for use in the separation of minerals in finely comminuted form from an aqueous pulp by the froth flotation process. The vessel includes a feed well 211 for feeding the aqueous pulp into the upper end of the flotation column, the pulp being received through a feed tube from an external source of aqueous slurry to deliver a controlled quantity of the slurry to the feed well 211. The feed well 211 may includes baffles (not shown) so that the aqueous slurry fed into the feed well becomes distributed throughout the flotation column.

The introduction of aerated water into the fluid vessel 210 is accomplished by means of a dual air system 221, 222 which provides two levels of aeration—one near the bottom of the vessel 210 and one about midway between the lower level and the top of the vessel. The aerated water that is introduced tends to flow upwardly through the aqueous slurry and the particulate matter suspended therein so that either the particles of the desired valuable mineral or the particles of the gangue suspended in the aqueous slurry adhere to the rising bubbles and collect at the upper end of the flotation column in the form of a froth. A launder 213 is provided at the upper end of the vessel 210 and is adapted to receive the froth which overflows from the top. An output conduit 214 is provided to convey the overflowing froth from the lauder 213 to further processing or storage apparatus.

The solid matter not captured by the levitating gas bubbles gravitates downwardly through the aqueous slurry until it collects at the bottom of the column and is removed through an underflow duct 215.

The Air Systems—General Arrangement

The systems for introducing an aqueous mixture containing minute gas bubbles includes an upper system 221 and a lower system 222, each of which has a microbubble generator 230. Gas under pressure is supplied to each of the microbubble generators 230 through an air inlet 223 that communicates with a compressor 224. An aqueous liquid is supplied to each microbubble generator 230 through a water inlet 225 which is connected to a pump 226 to provide the desired pressure and flow rate.

The upper air system 221 is essentially identical to the lower system 222 and, accordingly, like numerals are used to indicate like parts in the system components.

It has been found that the most effective arrangement comprises supplying about two-thirds of the aerated water through the lower system 222 and one-third through the upper system 221. Also, it is desirable that the tube sizes be selected to retain a uniform flow cross-section through the length of the flow so as to maintain a uniform flow velocity.

The Microbubble Generators

Each microbubble generator 230 is in the form of an elongated tube, typically about 48 inches long, and most of the components are fabricated of stainless steel. The generator includes an upper end member 231 and a lower end member 232 separated by an elongated, cylindrical, tubular housing 233. The upper end of the tubular housing 233 seats in an annular groove 234 formed in the adjacent face of the upper end member 231 and the lower end of the tubular housing 233 seats in an annular groove 235 formed in the adjoining face of the lower end member 232.

A threaded rod 236 extends through a central bore 237 in the upper end member 231, the bore having a narrowed throat portion 238. A cap nut 240, with an associated cap centering washer 239, is tightened down on the upper end of the rod 236 and seats in the throat portion 238. A radial air inlet port 241 and a radial water inlet port 232 are adapted to receive fittings that connect to air and water inlet lines, respectively. An inner fitting 243 seats against an annular axial extension 244 formed on the upper end member so that it does not block the bore 245 that communicates with the air inlet port 241.

An axially extending locator pin 250 extends into mating bores in the upper member 231 and in the inner fitting 243 to prevent relative rotation between the two parts.

An axially extending neck portion 246 of the inner fitting 243 extends upwardly into the axial bore 237. The lower portion of the neck 246 has a pair of spaced annular grooves 247 and 248 which receive seal rings. A central axial bore 251 is formed in the inner fitting 243, the bore being provided with a lower tapered portion 252. A tangential slot 253 is milled in the neck portion 246 adjacent the radial water inlet port 242 to provide a passage for water through the neck portion and into the central bore 251. The locater pin 250 assures that the tangential slot is directly aligned so that the water pressure is not blocked.

A pair of jamb nuts 254 and 255 are threaded on the rod 236 midway between its ends at a location just above the neck portion 246. The nuts serve to lock themselves in a fixed position on the threaded rod 236 and they bear against a locater washer 256 that, in turn, bears against the upper end of the neck portion 246.

Located within the tubular housing 233 and coaxial therewith is a porous, tubular sleeve 260 that extends axially between the lower end member 232 and the inner fitting 243. The upper end of the sleeve 260 seats in an annular groove 261 formed in the inner fitting 243 and bears against an annular gasket 263 positioned in the groove 261. The lower end of the porous sleeve 260 seats in an annular groove 262 formed in the lower end member 232 and bears against an annular gasket 264 that is seated in the bottom of the groove 262.

Porous sleeve 260 may be formed of the same materials described above in connection with the preceding embodiments.

The exterior surface of the porous sleeve 260 and the interior surface of the tubular housing 233 define an elongated, annular air chamber 265 that communicates with the air inlet port 241. The lower end member 232 has a drain port 267 formed therein communicating with the air chamber 265 and an associated drain valve to drain off accumulated oil and particles when necessary.

The lower end of the threaded rod 236 is received in a threaded axial bore 269 formed in the upper end of a tapered flow control form 270. Rod 270 tapers inwardly from a maximum diameter at the upper end thereof adjacent the upper end member 231 to a smaller diameter located adjacent the lower end member 232. The lower end of the tapered rod 270 is threaded and received in a threaded axial bore 273 formed in the lower end member 232.

Located above the threaded bore 273, and within the lower end member 232, is a transition chamber 274.

The exterior surface of the tapered flow control form 270 and the interior surface of the porous sleeve 260 define a fluid passage 275 that progressively increases in its annular cross-section in the direction of flow from the upper end of the microbubble generator 230 to the lower end thereof. The progressively increasing cross-section is designed to accommodate the progressive increase in the volume of the liquid/gas mixture as air is diffused into the flowing liquid through the porous sleeve 260. The infusion of the microbubbles results in more than doubling the volume as the flow progresses through the microbubble generator but, in accordance with the invention, the velocity remains roughly the same from one end of the generator to the other.

A plurality of discharge ports—in this case five—are formed in the lower end member 232 and all communicate with the transition chamber 274. The total cross-sectional area of the five discharge ports 276, 277, 278, 279, and 280 is designed to be slightly less than the maximum cross-sectional area of the annular flow passage 275 to avoid any fluid velocity decrease in the transition zone from the flow passage to the individual exit ports. Five flexible hoses 281, 282, 283, 284, and 285 are connected by threaded fittings to the respective discharge ports 276 through 280 to receive the aqueous fluid and convey it to the flotation column. Typical dimensions for the microbubble generator components and their relationship to the dimensions of the hoses 285 are shown in Table III below.

TABLE III

| | | | Microbubble Generator 230 (48" long) | | | | |
|---|---|---|---|---|---|---|---|
| Housing 233 O.D./I.D. (inches) | Porous Tube 260 O.D./I.D. (inches) | Control Form 270 Max. O.D. (inches) | Control Form 270 Min. O.D. (inch) | Transition Chamber 274 Max. Area (sq. inches) | Outlet Hoses I.D. (inch) | Outlet Hoses Flow Area (sq. inch) | Total Area of Outlet Hoses (sq. inches) |
| 4/3.75 | 2.925/2.215 | 2 | .5 | 1.616 | .625 | .307 | 1.534 |

The hoses 281–285 all extend through fitting assemblies in the wall of the flotation column into the interior of the column, where the aqueous liquid is discharged from ends of the flexible hoses directly into the column. The fitting assemblies at each instance include a compression fitting 286 tightly received around the hose, a connected fitting 287 between the compression fitting, a globe valve 288, and a short nipple 289 connected between the globe valve and the bushing 290 welded in place in the wall of the fluid vessel. The globe valve is turned to an open position and the hose extends completely through the bore in the globe valve.

Inside the flotation volume, the hoses 281 through 285 extend through stainless steel guide tubes 291 through 295 of varying lengths adapted to position the ends of the hoses at a position to achieve uniform air distribution. The guide tubes may be curved as desired to achieve the desired distribution. The hose ends 296 through 300 extend substantially beyond the ends of the rigid guide tubes 291 through 295 (e.g., about 8 inches), and are free to flex in an oscillating fashion as the air-infused mixture is discharged therefrom into the flotation column.

This arrangement provides minimum resistance to the flow of the gas-infused liquid from the microbubble generator to the flotation column, and prevents coalescence of bubbles which would otherwise reduce the effectiveness of the flotation column.

The flexible hoses 281–285 are preferably formed of reinforced polymeric material. A suitable tubing is formed of polyethylene with a metal braid embedded therein, such as is commercially available under the trade designation "TYCON."

By providing two levels of aeration in the flotation vessel, an improved performance is achieved. The second level helps to provide continuity of function and an improvement in flotation efficiency by the introduction of additional micron-size bubbles among those previously introduced at the lower level of aeration. The bubbles introduced at the lower level increase in size during their ascension in the flotation column, due to the decrease in fluid head pressure. The second level is typically located halfway between the lower aeration level and the top of the flotation compartment.

Another advantage of this arrangement is that when it is necessary to service one of the microbubble generators 230 or any of the associated air system components, only one of the two systems need be shut down for maintenance, the other system being effective to keep the column in operation (albeit with some reduced efficiency) during the short period of time necessary for service on the other system. As indicated above, the supply hoses can all be completely removed from the flotation column using the unique coupling arrangement described above.

Operation

The operation of the system shown will be described with respect to a vessel 210 filled with an aqueous pulp containing a mixture of a valuable mineral and gangue and wherein it is desired to separate by froth flotation the valuable mineral in the froth at the top of the column. The froth containing the float fraction is removed through the launder 213.

During the process, the aqueous pulp will be fed at a controlled rate through the feed pipe 212 into the feed well 211. Aerated water will be fed at a controlled rate through both the upper and lower distribution systems 221 and 222, the flow rate being about twice as great in the lower system as in the upper or intermediate system.

The process begins with the infusion of an aqueous liquid with microbubbles by means of the microbubble generators 230. Gas is supplied to the generators by the compressor 224 and water is supplied by means of the water pump 226 or head pressure, which pumps the water at a desired predetermined pressure. Recommended flow rates for various sizes of flotation cells are shown in tabular form in Table IV below, it being understood that these are variable. For example, satisfactory operation has been achieved using less water and air at lower pressure, ranging as low as 40 psi.

TABLE IV

| CELL DIA. | GENERATOR PSI (AIR) | AIR SUPPLY SCFM | GENERATOR PSI (WATER) | WATER SUPPLY GPM |
|---|---|---|---|---|
| 8" | 50 | 2 | 50 | .05 |
| 2.0' | 50 | 15 | 50 | .4 |
| 2.5' | 50 | 20 | 50 | .5 |
| 3.0' | 50 | 30 | 50 | .8 |
| 5.5' | 50 | 100 | 50 | 2.5 |
| 6.5' | 50 | 140 | 50 | 3.5 |
| 8.0' | 50 | 200 | 50 | 5.0 |
| 10.0' | 50 | 320 | 50 | 8.0 |
| 12.0' | 50 | 450 | 50 | 11.5 |

The gas, which may be air, for example, enters the microbubble generator 230 through the inlet port 241 and fills the air chamber 265 surrounding the exterior surface of the porous sleeve 260. The aqueous liquid, which is preferably water or brine mixed with a typical surfactant of the type well known in the art, is supplied through the radial port 242 and flows through the central passage 251 into the flow passage 275, where it remains in continuous contact with the interior surface of the porous sleeve 260.

The gas pressure in the gas chamber 265 forces air through the small pores (i.e., about 75 microns in pore size) so that it emerges at the cylindrical interior surface of the sleeve, where it contacts the flowing aqueous liquid. Due to the relatively high velocity of the liquid flow, the bubbles are sheared from the surface as they emerge and become entrained in the form of minute bubbles in the flowing stream. As the flowing stream progresses from the inlet end to the outlet end of the microbubble generator, its volume is substantially increased, due to the infusion of gas. Accordingly, the flow chamber 275 increases progressively in size at a rate adapted to accommodate the increase in volume without resulting in an excessive increase in velocity or pressure. If pressure and flow velocity are not properly maintained, the minute bubbles may coalesce and be less effective in separating the desired float fraction from the aqueous pulp.

By the time the flowing stream has reached the lower end of the microbubble generator, an optimum volume of gas has been entrained in the stream in the form of minute bubbles and the resulting mixture exists through the five discharge ports 276 through 280. The individual stream then conveyed through the respective hoses 281 through 285 into the interior of the flotation column and the resulting liquid is then delivered from the open ends of the hoses into the interior of the column. The minute gas bubbles then levitate through the aqueous slurry in the flotation column and the particles of the desired valuable mineral adhere to the bubbles and collect at the upper end of the flotation vessel in the form of froth. The froth overflows into the launder 213, where it is collected and delivered to the output conduit 214, which conveys it away for further processing.

Using the well-understood principle that bubble-rise time diminishes with size diminution, the apparatus herein disclosed provides for greater efficiency in material recovery. Since bubble size is small, retention time within the water column is correspondingly large. The finer bubbles provide maximum surface area for attachment to descending particles. Turbulence within the water column is minimized whereby bubbles tend to follow only substantially vertical paths.

Two levels or elevations of distribution pipes are used, thereby creating two recovery zones within the column 210, one between the two levels and the other above the upper level. The lower level is two to four feet above the underflow duct 215 in the bottom of the column 210, while the upper level is disposed midway between the lower level and the upper end of the column 210.

In the upper recovery zone, bubbles from both levels will obtain. In the lower zone, the only bubbles will be those from the lower level. Thus, bubble density is correspondingly different in the two zones. Bubbles in the upper zone, being more concentrated, attach to and immediately float off that particle fraction most susceptible to float separation. The remaining particles descend through the lower zone where the fine bubbles are ascending relatively slowly, the slow ascent creating more time during which attachment to descending particles may occur. Primary recovery, therefore, may be said to occur in the upper zone, and scavenging in the lower zone.

Of importance is the fact that bubble generation and sizing are external to the column 210 and that the same size bubbles are fed to both of the upper and lower sets of pipes. Since rising bubbles progressively expand in size, those bubbles introduced at the lower level will enlarge by the time they reach the upper level. Thus, some of the desired qualities of tiny bubbles will there be lost. However, tiny bubbles are introduced at the upper level and will rise vertically, providing maximum surface area for particle attachment. Thus, by means of multilevel bubble introduction of externally generated bubbles, bubble size is maintained optimally small, thereby enhancing the probability of particle attachment.

Tiny bubble introduction at the different levels also minimize turbulence within the column water. Smaller bubbles tend to create less disturbance and to follow vertical paths. Thus, there will be minimal turbulence in the lower zone, as bubble size is small. In the upper zone where bubble concentration is greater, the distance to the water surface is relatively short and the introduction of small bubbles tends to infiltrate smaller bubbles with the enlarged ones and ascendancy remains substantially vertical. Turbulence in the form of circular motion or boiling action is thereby minimized, contributing further to the efficiency of material pick-up. The two levels of distributor pipes at the two levels, receiving and emitting the same size bubbles, inhibit development of turbulence, thereby enhancing column efficiency.

FIGS. 21-23

Figure 21:
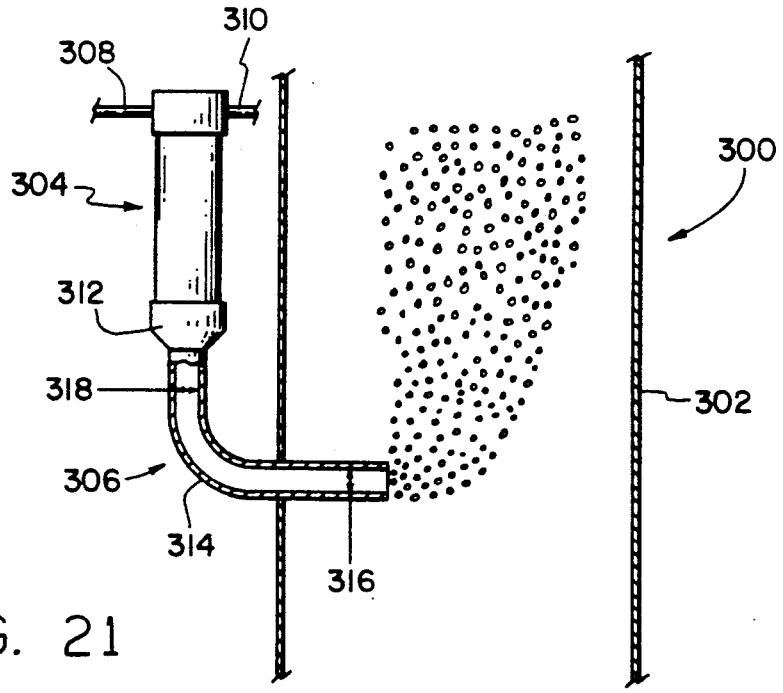
FIG. 21 is a schematic representation of a portion of a flotation cell and microbubble generator which illustrates a preferred technique for conducting the liquid/-bubble mixture to the vessel.

FIG. 21 is a schematic representation of a portion of a flotation cell 300 which includes a fluid-filled vessel 302, a microbubble generator 304, and a schematically illustrated piping system 306 for conducting a bubble/-liquid mixture from microbubble generator 304 to the interior of vessel 302. Microbubble generator 304 receives gas under pressure through an air inlet 308 and water under pressure through a water inlet 310. In these and other respects, microbubble generator 304 is similar to the microbubble generators described above. However, other generator designs may alternatively be used with the components described below.

Piping system 306 is attached to the discharge end 312 of microbubble generator 304. Piping system 306 includes at least one conduit 314 for conducting the pressurized mixture of gaseous bubbles and liquid from microbubble generator 304 to the interior of fluid vessel 302. Conduit 314 is specifically designed to inhibit the coalescence and enlargement of the bubbles in the mixture prior to introduction of the mixture into the vessel. Specifically, the length and flow diameter of conduit 314 are selected and designed so as to inhibit coalescence and enlargement of the bubbles in the conduit which may occur if the pressure inside the conduit is reduced significantly or if a substantial degree of turbulence is introduced into the flow stream. With regard to length, microbubble generator 304 is generally positioned adjacent fluid vessel 302 so as to reduce the overall length of conduit 314 as much as practical, while still providing for adequate distribution of the bubbles throughout the cross-section of fluid vessel 302. In practice, it has been found that conduit lengths of less than six feet will conduct the bubble/water mixture into the flotation cell without undue bubble enlargement. Slightly longer lengths may be used if necessary, but excessively long lengths of piping to convey the mixture should be avoided.

With regard to the flow diameter of conduit 314, the size of the conduit used may vary depending upon the size and capacity of the flotation cell and fluid vessel 302. However, regardless of the specific cross-sectional dimension chosen, the inner diameter of conduit 314 should be substantially uniform and continuous throughout its length so as to reduce local disturbances of fluid flow which may tend to cause coalescence and enlargement of the bubbles. Furthermore, the pressure and velocity of the mixture flowing in conduit 314 should be maintained substantially constant. This can be accomplished by specifying the inside diameter of the downstream end 316 of conduit 314 to be not greater than (i.e., is less than or equal to) the inside diameter of the upstream end 318.

FIG. 21 illustrates a system in which a single conduit 314 is used to conduct the bubble/liquid mixture from microbubble generator 304 to the interior of fluid vessel 302. In practice, a plurality of conduits may be used, as illustrated in FIGS. 9 and 14 above. In general, the same considerations regarding lengths and flow diameters apply in these instances (i.e., lengths and flow diameters are specifically selected and designed so as to inhibit coalescence and enlargement of the bubbles prior to introduction of the mixture into the fluid vessel).

Figure 22:
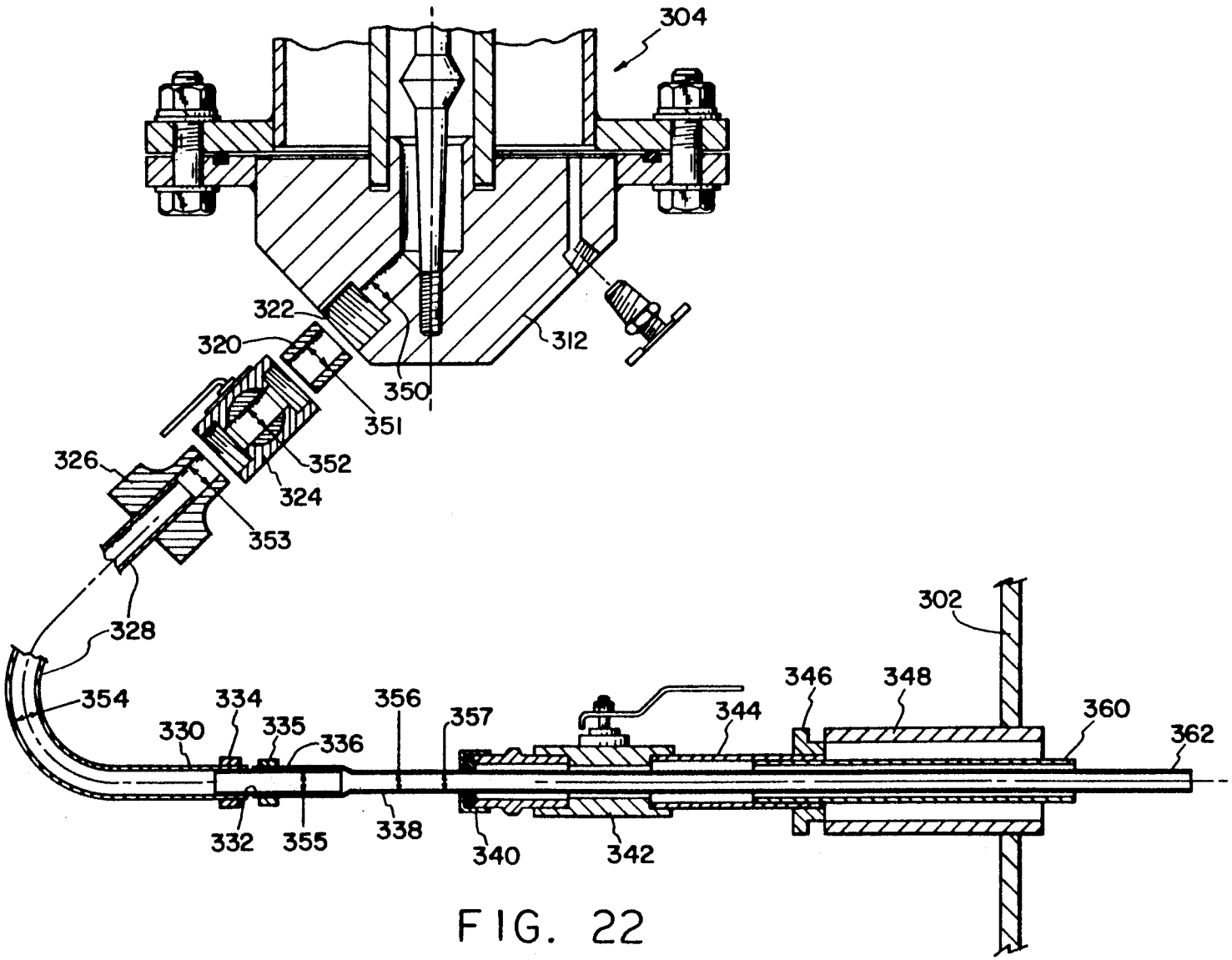
FIG. 22 is a longitudinal cross-sectional view of a portion of an arrangement for conducting the liquid/-bubble mixture from the microbubble generator to the vessel.

FIG. 22 shows a longitudinal cross-sectional view of a portion of a preferred arrangement for conducting the bubble/liquid mixture from microbubble generator 304 to the interior of fluid vessel 302. The arrangement includes a threaded nipple 320 which screws into a threaded opening 322 in discharge end 312 of microbubble generator 304. A valve 324 is threaded onto a portion of nipple 320 which is left protruding from opening 322 when nipple 320 is fully seated. A compression coupling 326 is fitting onto the downstream end of valve 324. The downstream end of coupling 326 accepts and secures the upstream end of a length of flexible tubing 328. In one embodiment, a flexible plastic tubing having a wall thickness of approximately ⅛" is used.

It is possible to use, in combination with the remaining downstream components described below, a continuous length of tubing 328 to conduct the bubble/liquid mixture from the downstream end of coupling 326 to the interior of fluid vessel 302. However, in a preferred embodiment, the flexible tube is formed in at least two sections. The first section (tube 328) extends from a point closely adjacent discharge end 312 of microbubble generator 304 (i.e., from coupling 326) to a connection point which is located substantially adjacent fluid vessel 302. A second section of tubing, which is more flexible than the first, extends from the connection point into the fluid vessel. In the embodiment illustrated in FIG. 22, downstream end 330 of tube 328 is fitted over a relatively rigid tubing connector 332 and secured to connector 332 by clamp 334. Secured by a second clamp 335 to the downstream end of connector 332 is upstream end 336 of a second section of tubing 338. In the particular embodiment illustrated, tubing 338 has a wall thickness of approximately 1/16" and is considerably more flexible than tubing 328. Tubing 338 extends through a compression grip fitting 340 which is threaded into the upstream end of a ball valve 342. The downstream end of valve 342 is secured to a supporting connector 344 which, in turn, is secured by a bushing 346 and inlet coupling 348 to the exterior wall of fluid vessel 302. Tubing 338 extends through compression fitting 340, valve 342, connector 344, bushing 346 and coupling 348 into the interior of fluid vessel 302. This construction allows for easy maintenance, repair and replacement of worn tubing sections, without having to drain the fluid from vessel 302. When an inspection or repair becomes necessary, compression fitting 340 may be loosened slightly to allow tubing 338 to be withdrawn from the vessel. When the tip of the downstream end 362 of tubing 338 passes through valve 342 (and before the tip passes through compression fitting 340), valve 342 can be closed. After valve 342 is closed, tubing 338 can be completely removed from compression fitting 340 without loss of fluid from within vessel 302.

An important aspect of the arrangement shown in FIG. 22 is illustrated by arrows 350–357. These arrows are intended to illustrate that the inside diameter at various points along the flow path remains relatively constant. In addition, the inside diameter is substantially continuous and uniform so as to avoid any discontinuities which tend to create turbulence and cause pressure drops which may lead to coalescence and enlargement of bubbles in the mixture. Thus, each of the various connections to and between components 320–338 is specifically designed to maintain the uniform and continuous nature of the flow stream.

Also shown in FIG. 22 is a relatively rigid support tube 360 which extends into the interior of fluid vessel 302. A downstream end 362 of tubing 338 extends through and beyond the end of rigid guide tube 360. As discussed previously, downstream end 362 of relatively flexible tubing 338 is free to flex in an oscillating fashion as the bubble/liquid mixture is discharged into fluid vessel 302.

Figure 23:
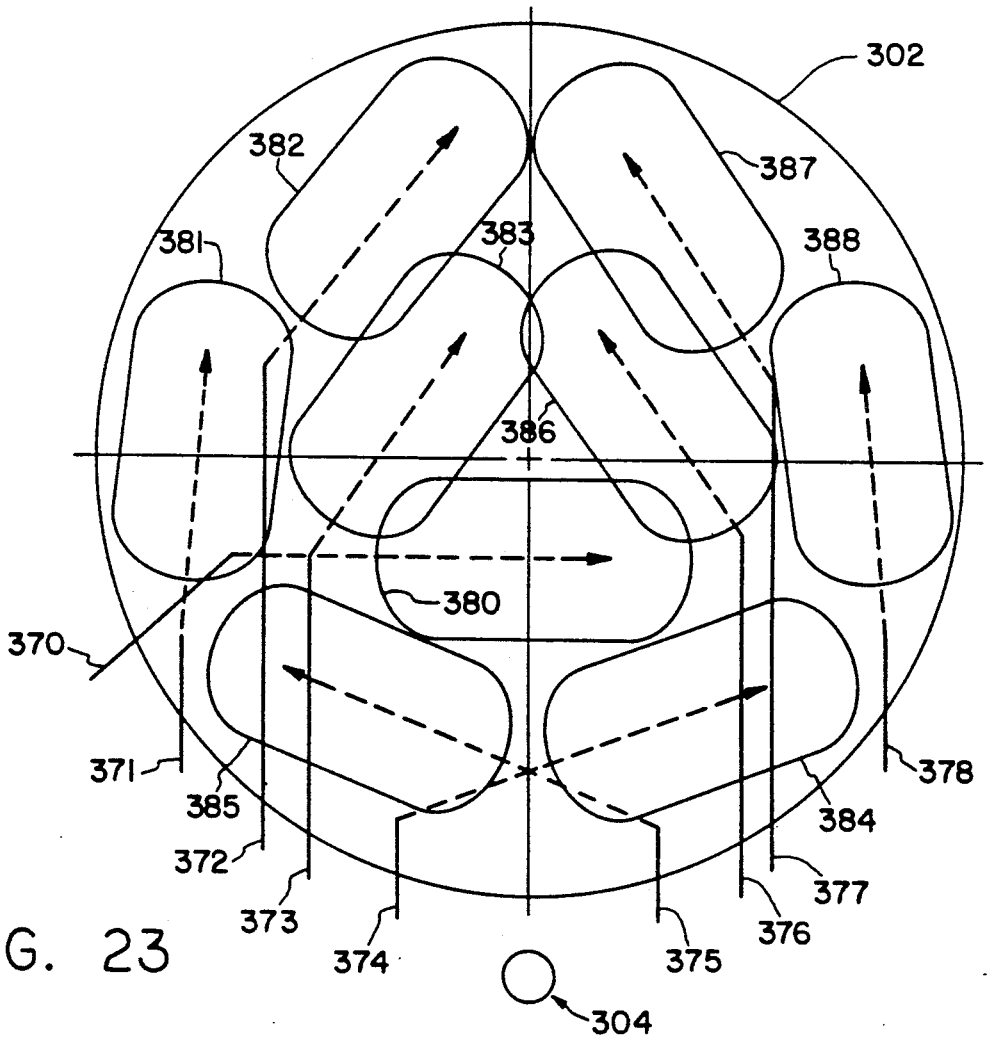
FIG. 23 is a schematic representation illustrating the pattern of bubble distribution within the vessel.

Although the arrangement shown in FIG. 22 illustrates a single flow path extending from discharge end 312 of microbubble generator 304 to the interior of fluid vessel 302, a plurality of similarly constructed flow paths may be used and, in general, is preferred. When a plurality of tubing ends 362 extend into the fluid vessel, the various ends are spaced apart, both horizontally and, in some cases, vertically, to provide for a more even distribution of the mixture throughout a cross-section of the fluid vessel. FIG. 23 shows a cross-section through fluid vessel 302. Each of the lines 370–378 represent the ends (362) of the relatively flexible tubing (338) which extend into the interior of vessel 302. The solid portion of each line represents the relatively rigid guide tube (360), while the dashed line represents the portion (362) of the flexible tubing which extends beyond the guide tube and is free to flex in an oscillating manner. Each of the areas 380–388 represents the approximate area in which the oscillating end of the corresponding flexible tube discharges the bubble/liquid mixture into vessel 302. As illustrated by FIG. 23, the rigid guide tubes and flexible tubing ends are spaced within the cross-section of vessel 302 so as to provide substantially complete and uniform distribution of the mixture throughout the cross-section of the vessel. The tubing ends may be spaced vertically, as well as horizontally, to avoid Possible interferences between adjacent tubing ends.

While air and water are preferred in the working embodiments of this invention, gases other than air, such as nitrogen, and liquids other than water may be used. Thus, the words "air" and "water" and the term "aerated water" are intended to include these equivalents.

In the present invention, generation of microsized bubbles enhances the efficiency of the flotation mechanism through increased surface area of the bubbles while reducing the air volume requirements typical of present flotation mechanisms. The system requires lower air and water pressures (35–50 psig) and lower water volume (0.15 GPM/SCFM) than other microbubble systems, which usually require a minimum of 80 psig air and water pressure and water requirements of at least 3 GPM/SCFM.

While the invention has been shown and described with respect to specific embodiments thereof, this is intended for the purpose of illustration rather than limitation, and other variations and modifications of the specific method and apparatus herein shown and described will be apparent to those skilled in the art, all within the intended spirit and scope of the invention. Accordingly, the patent is not to be limited in scope and effect to the specific embodiments herein shown and described, nor in any other way that is inconsistent with the extent to which progress in the art has been advanced by the invention.

What is claimed is:

1. A column flotation cell for separating particulate material from an aqueous pulp by froth flotation, comprising:

a fluid vessel having means for receiving the aqueous pulp in an upper portion thereof;

microbubble generator means, mounted exteriorly of the fluid vessel, for generating a pressurized mixture of liquid and gaseous bubbles of a predetermined size;

means for conducting the pressurized mixture of gaseous bubbles and liquid from the microbubble generator to the fluid vessel, and for inhibiting the coalescence and enlargement of the bubbles prior to introduction of the mixture into the vesel; and means for introducing the mixture into the vessel, and for distributing the mixture uniformly throughout a cross-section of the vessel;

wherein said means for conducting the pressurized mixture from the microbubble generator to the vessel, and for inhibiting the coalescence and enlargement of the bubbles comprises a plurality of conduits extending from discharge end of the microbubble generator to the vessel, each of said conduits having a predetermined length and flow diameter selected so as to inhibit coalescence and enlargement of the bubbles.

2. A column flotation cell according to claim 1, wherein said conduits have substantially uniform and continuous inside diameters so as to reduce local disturbances of fluid flow which would tend to cause coalescence and enlargement of the bubbles.

3. A column flotation cell according to claim 2, wherein the inside diameters of said conduits of the downstream ends are not greater than the inside diameters of the upstream ends so as to maintain the pressure and velocity of the mixture flow substantially constant.

4. A column flotation cell for separating particulate material from an aqueous pulp by froth flotation, comprising:

a fluid vessel having means for receiving the aqueous pulp in an upper portion thereof;

microbubble generator means, mounted exteriorly of the fluid vessel, for generating a pressurized mixture of liquid and gaseous bubbles of a predetermined size;

means for conducting the pressurized mixture of gaseous bubbles and liquid from the microbubble generator to the fluid vessel, and for inhibiting the coalescence and enlargement of the bubbles prior to introduction of the mixture into the vessel; and means for introducing the mixture into the vessel, and for distributing the mixture uniformly throughout a cross-section of the vessel;

wherein said means for conducting the pressurized mixture from the microbubble generator to the vessel, and for inhibiting the coalescence and enlargement of the bubbles comprises a plurality of flexible tubes, extending from a discharge end of the microbubble generator to the interior of the fluid vessel, each of said tubes having a predetermined length and flow diameter selected so as to inhibit coalescence and enlargement of the bubbles.

5. A column flotation cell according to claim 4, wherein each of said flexible tubes is formed in at least two sections, a first section extending from the microbubble generator to a connection point substantially adjacent an exterior wall of the fluid vessel, and a second section extending from the connection point into the fluid vessel, and wherein the first section is substantially less flexible than the second section.

6. A column flotation cell according to claim 4, further comprising a plurality of valves mounted exteriorly of the vessel, and wherein each of said flexible tubes passes through one of said valves when said valve is in an open position, and wherein said valve can be moved to a closed position when the flexible tube is withdrawn from the vessel through the valve.

7. A column flotation cell according to claim 6, further comprising a plurality of bushings mounted in openings in an exterior wall of the vessel, means for sealingly connecting a downstream end of one of said valves to a respective one of said bushings, and means for effecting a seal between an upstream end of said valve and an exterior surface of the respective tube which passes through said valve.

8. A column flotation cell according to claim 7, further comprising a plurality of relatively rigid guide tubes connected to respective ones of said bushings and extending into the interior of the vessel, each of said flexible tubes extending through one of said relatively rigid guide tubes.

9. A column flotation cell for separating particulate material from an aqueous pulp by froth flotation, comprising:

a fluid vessel having means for receiving the aqueous pulp in an upper portion thereof;

microbubble generator means, mounted exteriorly of the fluid vessel, for generating a pressurized mixture of liquid and gaseous bubbles of a predetermined size;

a plurality of flexible tubes, extending from a discharge end of the microbubble generator to the interior of the fluid vessel, each of said tubes having a predetermined length and flow diameter selected so as to inhibit coalescence and enlargement of the bubbles, each of said tubes having an open end positioned within the vessel in spaced relation so as to uniformly distribute the mixture throughout a cross-section of the vessel.

10. A column flotation cell according to claim 9, wherein each of said flexible tubes has a substantially uniform and continuous inside diameter so as to minimize local disturbances of fluid flow which would tend to cause coalescence and enlargement of the bubbles.

11. A column flotation cell according to claim 10, wherein the inside diameter of the downstream end of each of said flexible tubes is not greater than the inside diameter of the upstream end so as to maintain the pressure and velocity of the mixture flow substantially constant.

12. A column flotation cell according to claim 9, further comprising a plurality of relatively rigid guide tubes extending inwardly from a wall of the fluid vessel, wherein said flexible tubes extend into the vessel through respective ones of said guide tubes.

13. A column flotation cell according to claim 12, wherein said guide tubes are of varying lengths so as to uniformly position the open ends of the flexible tubes throughout the cross-section of the vessel.

14. A column flotation cell according to claim 13, wherein said open ends of the flexible tubes extend substantially beyond the ends of the rigid guide tubes, and are free to flex in an oscillating fashion as the mixture is discharged therefrom into the fluid vessel.

15. A column flotation cell according to claim 14, wherein each of the ends of the flexible tubes flexes within a predetermined portion of the cross-section of the vessel, and wherein the ends of the tubes are spaced within the vessel to provide substantially complete distribution of the mixture throughout the cross-section of the vessel.

16. A column flotation cell according to claim 15, wherein the ends of the tubes are spaced vertically and horizontally within the vessel to provide substantially complete distribution of the mixture throughout the cross-section of the vessel, while avoiding interference between the oscillating ends.

17. A column flotation cell according to claim 9, further comprising a plurality of valves mounted exteriorly of the vessel, and wherein each of said flexible tubes passes through one of said valves when said valve is in an open position, and wherein said valve can be moved to a closed position when the flexible tube is withdrawn from the vessel through the valve.

18. A column flotation cell according to claim 17, further comprising a plurality of bushings mounted in openings in an exterior wall of the vessel, means for sealingly connecting a downstream end of one of said valves to a respective one of said bushings, and means for effecting a seal between an upstream end of said valve and an exterior surface of the respective tube which passes through said valve.

19. A column flotation cell according to claim 18, further comprising a plurality of relatively rigid guide tubes connected to respective ones of said bushings and extending into the interior of the vessel, each of said flexible tubes extending through one of said relatively rigid guide tubes.

20. A column flotation cell according to claim 19, wherein said guide tubes are of varying lengths so as to uniformly position the open ends of the flexible tubes throughout the cross-section of the vessel.

21. A column flotation cell according to claim 20, wherein said open ends of the flexible tubes extend substantially beyond the ends of the rigid guide tubes, and are free to flex in an oscillating fashion as the mixture is discharged therefrom into the fluid vessel.

22. A column flotation cell according to claim 21, wherein each of the ends of the flexible tubes flexes within a predetermined portion of the cross-section of the vessel, and wherein the ends of the tubes are spaced within the vessel to provide substantially complete and non-overlapping distribution of the mixture throughout the cross-section of the vessel.

23. A column flotation cell according to claim 21, wherein the ends of the tubes are spaced vertically and horizontally within the vessel to provide substantially complete distribution of the mixture throughout the cross-section of the vessel, while avoiding interference between the oscillating ends.

* * * * *